US007222569B2

(12) United States Patent
Kusaka et al.

(10) Patent No.: US 7,222,569 B2
(45) Date of Patent: May 29, 2007

(54) OSCILLATION AMOUNT ADJUSTING DEVICE FOR OSCILLATING ROLLER

(75) Inventors: Akehiro Kusaka, Noda (JP); Takashi Fuseki, Toride (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 11/494,457

(22) Filed: Jul. 28, 2006

(65) Prior Publication Data

US 2006/0272528 A1 Dec. 7, 2006

Related U.S. Application Data

(62) Division of application No. 10/895,924, filed on Jul. 22, 2004, now Pat. No. 7,104,197.

(30) Foreign Application Priority Data

Jul. 23, 2003 (JP) ..... 2003-200299

(51) Int. Cl.
*B41F 31/00* (2006.01)

(52) U.S. Cl. ..... 101/352.06; 101/350.03; 101/DIG. 38

(58) Field of Classification Search ..... 101/148, 101/277, 349.1, 350.1, 350.3, 352.06, DIG. 38
See application file for complete search history.

(56) References Cited

U.S. PATENT DOCUMENTS

| | | | |
|---|---|---|---|
| 4,332,195 | A | 6/1982 | Mizumura |
| 4,972,771 | A | 11/1990 | Weisgerber et al. |
| 5,060,568 | A | 10/1991 | Jentzsch et al. |
| 5,363,763 | A | 11/1994 | Fiore |
| 6,019,038 | A | 2/2000 | Kusunoki et al. |
| 6,220,159 | B1 | 4/2001 | Wieland |
| 6,546,865 | B2 | 4/2003 | Fischer et al. |
| 6,578,481 | B1 | 6/2003 | Beisel et al. |
| 6,691,612 | B1 | 2/2004 | Herrmann et al. |

FOREIGN PATENT DOCUMENTS

| | | |
|---|---|---|
| JP | 54-3763 | 2/1979 |
| JP | 56-6864 B2 | 2/1981 |
| JP | 61-237645 A | 10/1986 |
| JP | 2001-199051 A | 7/2001 |

*Primary Examiner*—Ren Yan
(74) *Attorney, Agent, or Firm*—Birch, Stewart, Kolasch & Birch, LLP

(57) ABSTRACT

An oscillation amount adjusting device for an oscillating roller has a sleeve detent plate for restraining the rotation of a sleeve. An operator manually loosens a sleeve locking bolt to render the sleeve rotatable relative to a rotating shaft supporting the sleeve. The rotation of the sleeve is restrained by the sleeve detent plate. In this state, the rotating shaft supporting the sleeve is rotated by an oscillation drive motor to adjust the oscillation amount of oscillating rollers.

5 Claims, 16 Drawing Sheets

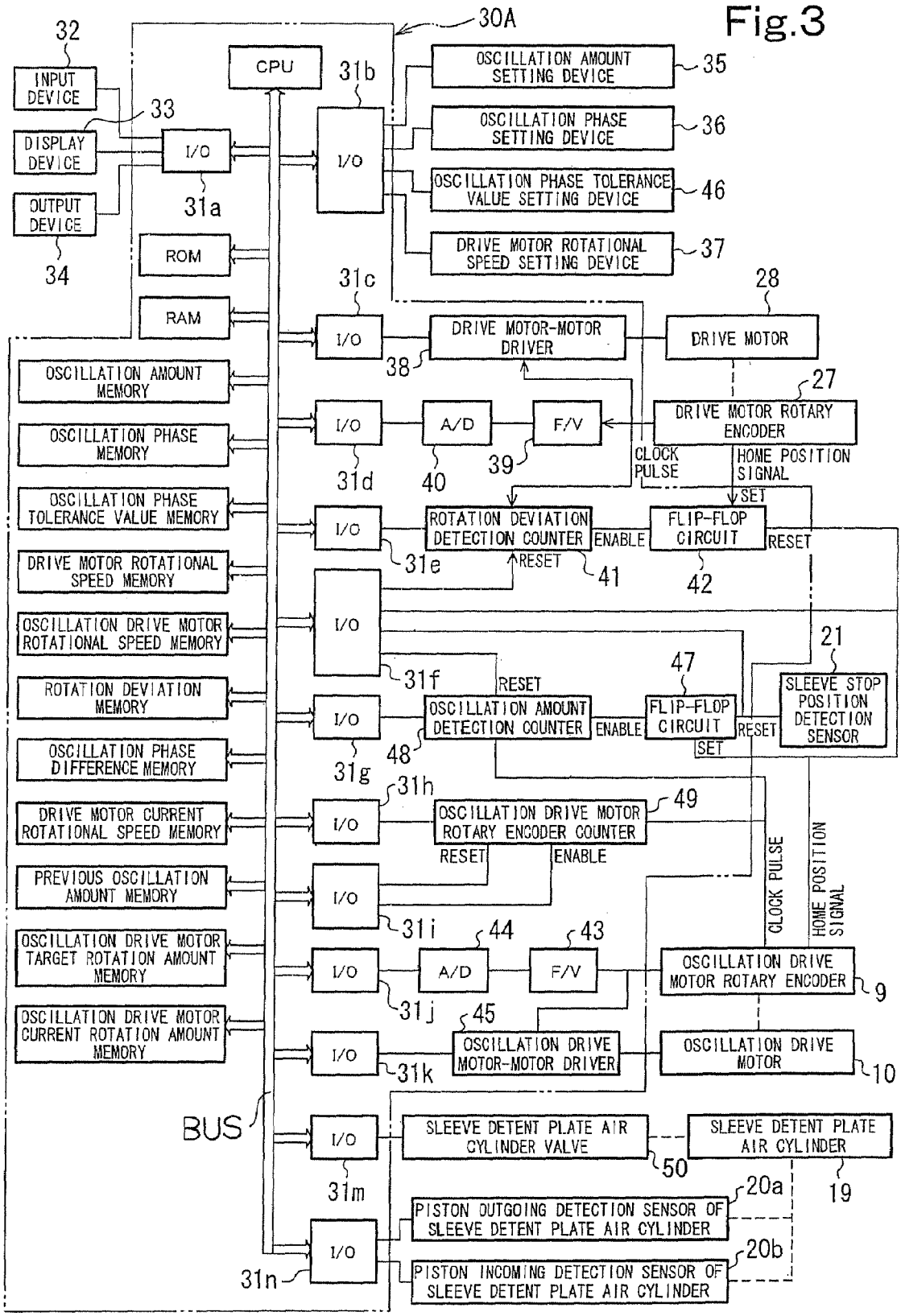
Fig.3
30A
32
INPUT DEVICE
33
DISPLAY DEVICE
OUTPUT DEVICE
34
I/O
31a
CPU
ROM
RAM
31b
I/O
OSCILLATION AMOUNT SETTING DEVICE
35
OSCILLATION PHASE SETTING DEVICE
36
OSCILLATION PHASE TOLERANCE VALUE SETTING DEVICE
46
DRIVE MOTOR ROTATIONAL SPEED SETTING DEVICE
37
31c
I/O
DRIVE MOTOR-MOTOR DRIVER
38
28
DRIVE MOTOR
27
DRIVE MOTOR ROTARY ENCODER
OSCILLATION AMOUNT MEMORY
OSCILLATION PHASE MEMORY
OSCILLATION PHASE TOLERANCE VALUE MEMORY
DRIVE MOTOR ROTATIONAL SPEED MEMORY
OSCILLATION DRIVE MOTOR ROTATIONAL SPEED MEMORY
ROTATION DEVIATION MEMORY
OSCILLATION PHASE DIFFERENCE MEMORY
DRIVE MOTOR CURRENT ROTATIONAL SPEED MEMORY
PREVIOUS OSCILLATION AMOUNT MEMORY
OSCILLATION DRIVE MOTOR TARGET ROTATION AMOUNT MEMORY
OSCILLATION DRIVE MOTOR CURRENT ROTATION AMOUNT MEMORY
I/O
A/D
F/V
31d
40
39
CLOCK PULSE
HOME POSITION SIGNAL
SET
ROTATION DEVIATION DETECTION COUNTER
ENABLE
FLIP-FLOP CIRCUIT
RESET
31e
41
42
31f
21
47
SLEEVE STOP POSITION DETECTION SENSOR
OSCILLATION AMOUNT DETECTION COUNTER
31g
48
31h
OSCILLATION DRIVE MOTOR ROTARY ENCODER COUNTER
49
31i
44
43
OSCILLATION DRIVE MOTOR ROTARY ENCODER
9
31j
45
OSCILLATION DRIVE MOTOR-MOTOR DRIVER
OSCILLATION DRIVE MOTOR
10
31k
BUS
SLEEVE DETENT PLATE AIR CYLINDER VALVE
50
SLEEVE DETENT PLATE AIR CYLINDER
19
31m
20a
PISTON OUTGOING DETECTION SENSOR OF SLEEVE DETENT PLATE AIR CYLINDER
20b
PISTON INCOMING DETECTION SENSOR OF SLEEVE DETENT PLATE AIR CYLINDER
31n

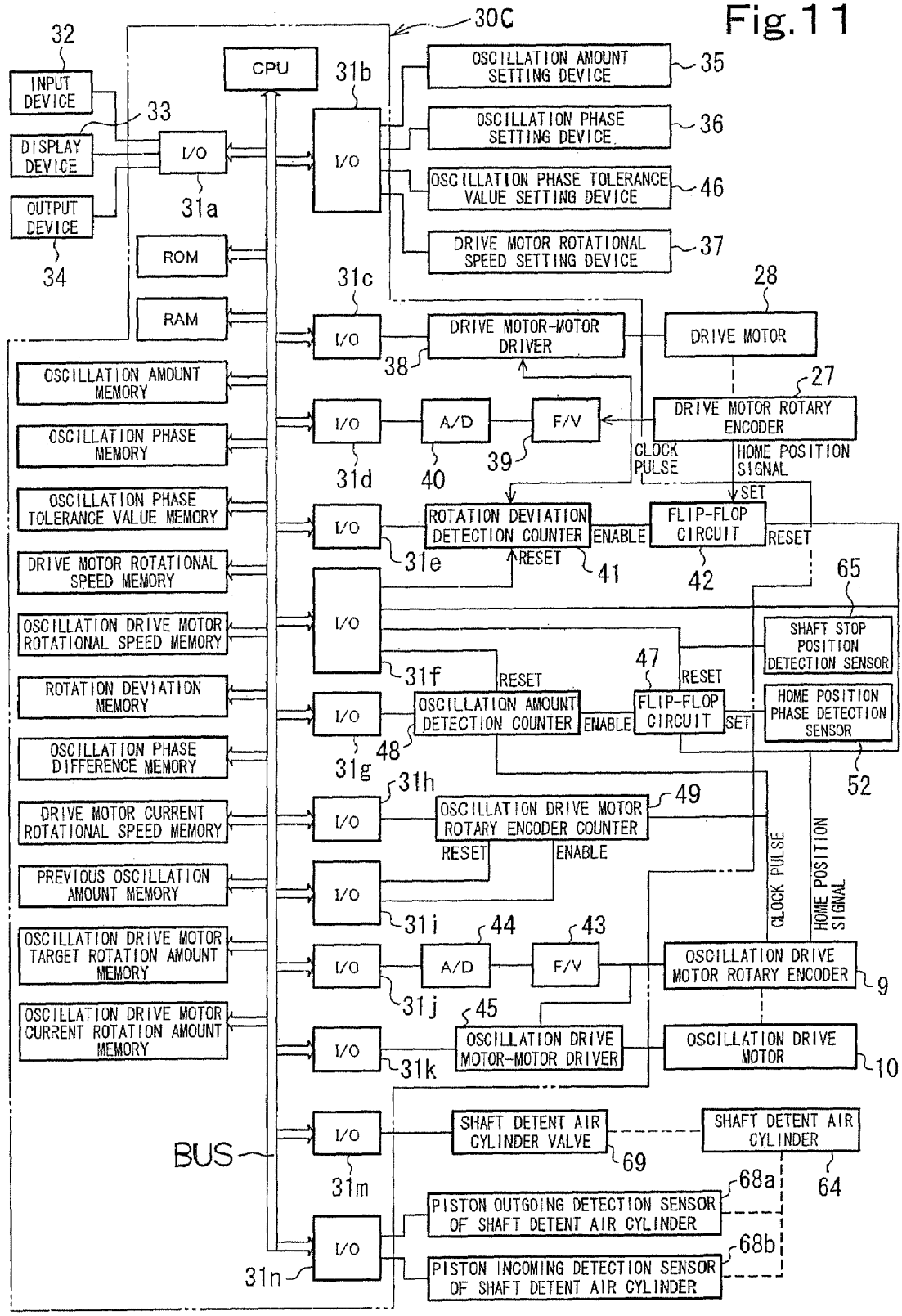
Fig.11
30C
32
INPUT DEVICE
33
DISPLAY DEVICE
OUTPUT DEVICE
34
CPU
I/O
31a
ROM
RAM
31b
OSCILLATION AMOUNT SETTING DEVICE
35
OSCILLATION PHASE SETTING DEVICE
36
OSCILLATION PHASE TOLERANCE VALUE SETTING DEVICE
46
DRIVE MOTOR ROTATIONAL SPEED SETTING DEVICE
37
31c
28
DRIVE MOTOR-MOTOR DRIVER
38
DRIVE MOTOR
27
DRIVE MOTOR ROTARY ENCODER
A/D
F/V
31d
40
39
CLOCK PULSE
HOME POSITION SIGNAL
SET
ROTATION DEVIATION DETECTION COUNTER
ENABLE
FLIP-FLOP CIRCUIT
RESET
31e
41
42
65
SHAFT STOP POSITION DETECTION SENSOR
31f
47
OSCILLATION AMOUNT DETECTION COUNTER
HOME POSITION PHASE DETECTION SENSOR
31g
48
52
31h
OSCILLATION DRIVE MOTOR ROTARY ENCODER COUNTER
49
31i
44
43
OSCILLATION DRIVE MOTOR ROTARY ENCODER
9
31j
45
OSCILLATION DRIVE MOTOR-MOTOR DRIVER
OSCILLATION DRIVE MOTOR
10
31k
OSCILLATION AMOUNT MEMORY
OSCILLATION PHASE MEMORY
OSCILLATION PHASE TOLERANCE VALUE MEMORY
DRIVE MOTOR ROTATIONAL SPEED MEMORY
OSCILLATION DRIVE MOTOR ROTATIONAL SPEED MEMORY
ROTATION DEVIATION MEMORY
OSCILLATION PHASE DIFFERENCE MEMORY
DRIVE MOTOR CURRENT ROTATIONAL SPEED MEMORY
PREVIOUS OSCILLATION AMOUNT MEMORY
OSCILLATION DRIVE MOTOR TARGET ROTATION AMOUNT MEMORY
OSCILLATION DRIVE MOTOR CURRENT ROTATION AMOUNT MEMORY
BUS
31m
SHAFT DETENT AIR CYLINDER VALVE
69
SHAFT DETENT AIR CYLINDER
64
68a
PISTON OUTGOING DETECTION SENSOR OF SHAFT DETENT AIR CYLINDER
68b
PISTON INCOMING DETECTION SENSOR OF SHAFT DETENT AIR CYLINDER
31n

OSCILLATION AMOUNT ADJUSTING DEVICE FOR OSCILLATING ROLLER

CROSS REFERENCE TO RELATED APPLICATIONS

This application is a Divisional of application Ser. No. 10/895,924, filed on Jul. 22, 2004 now U.S. Pat. No. 7,104,197, the entire contents of which are hereby incorporated by reference and for which priority is claimed under 35 U.S.C. § 120.

This Nonprovisional application claims priority under 35 U.S.C. § 119(a) on Japanese Patent Application No. 2003-200299 filed on Jul. 23, 2003, the entire contents of which are hereby incorporated by reference.

BACKGROUND OF THE INVENTION

1. Field of the Invention

This invention relates to an oscillation amount adjusting device for an oscillating roller in an inking device of a printing press. More specifically, the invention relates to an oscillation amount adjusting device which can make adjustment by remote and automatic control using a motor while achieving space saving without exerting adverse influence on printing.

2. Description of the Related Art

In an inking device of a printing press, ink in an ink reservoir is sequentially fed to many distribution rollers via ink ductor rollers. In the distribution rollers, the ink is uniformly distributed, and transferred to a printing plate supported on the circumferential surface of a plate cylinder. The above-mentioned many distribution rollers consist of combinations of metal rollers and rubber rollers. Among them, the metal roller is called an oscillating roller, which is designed to swing laterally (in a roller axis direction) under the action of a swing device (oscillation mechanism) while rotating, thereby distributing the ink uniformly.

When rainbow printing is to be performed, or when the machine speed has been changed, it becomes important to adjust the oscillation amount of the oscillating roller. A conventional oscillation amount adjusting device for adjusting the amount of oscillation by remote and automatic control is disclosed, for example, in Japanese Patent Application Laid-Open No. 2001-199051 (hereinafter referred to as Patent Document 1). However, this oscillation amount adjusting device has a large-scale drive system composed of a rotating drum, a shaft, a lever, and a link plate, thus requiring a large space, posing the problem that its installation may be difficult in view of roller arrangement and its relation with other devices.

Furthermore, the oscillation amount adjusting device of Patent Document 1 swings a plurality of oscillating rollers in the roller axis direction by interconnecting these rollers by levers. Thus, the plurality of oscillating rollers simultaneously stop at the position of the swing end, presenting the problem that the thickness of an ink film tends to be uneven. Also, the plurality of oscillating rollers simultaneously stop and begin to move in the reverse direction, causing the problem that shock due to load increases to affect printing adversely.

To solve these problems, it is conceivable to adopt an oscillation mechanism designed to produce differences in the phase of each oscillating roller in its swing motion by the grinding motion of a disk, as disclosed in Japanese Patent Publication No. 1979-3763 (hereinafter referred to as Patent Document 2).

In adjusting the oscillation amount of the oscillating roller in the oscillation mechanism disclosed in the above-mentioned Patent Document 2, a method as disclosed in Japanese Patent Publication No. 1981-6864 (hereinafter referred to as Patent Document 3) is adopted. As shown in FIG. 16, a cylindrical sleeve 102 having an outer peripheral surface inclined with respect to the axis of an inclined shaft portion 101 of a rotating shaft 100 is rotatably fitted on the inclined shaft portion 101, and shaft ends of a plurality of oscillating rollers 104*a*, 104*b*. . . are rotatably supported on a disk 103 rotatably supported by the sleeve 102.

Thus, when the rotating shaft 100 is rotated in a manner interlocked with a drive motor or the like of a printing press, the inclined shaft portion 101 of the rotating shaft 100, which has an inclined axis, makes an oscillatory motion. The disk 103, which is journaled about the inclined shaft portion 101 via the sleeve 102, makes a so-called grinding motion. During this process, the oscillating rollers 104*a*, 104*b*. . . swing in the axial direction, with their phases being sequentially shifted in accordance with the order of arrangement of the oscillating rollers 104*a*, 104*b* . . . .

In adjusting the amount of oscillation of the oscillating rollers 104*a*, 104*b*. . . , driving of the printing press is once shut down. Then, an operator loosens an adjusting bolt 105 manually, inserts a tool into a hole 102*a* of the sleeve 102 to rotate the sleeve 102 by a predetermined angle, and then tightens the adjusting bolt 105 to lock the sleeve 102 to the rotating shaft 100 again.

In the oscillation amount adjusting device disclosed in the aforementioned Patent Document 3, the operator has to rotate the sleeve 102 manually while moving all of the oscillating rollers 104*a*, 104*b*. . . remaining stopped. Thus, a burden is imposed on the operator. Moreover, the accuracy of adjustment depends on the technical ability of the individual operator. Hence, if, after adjustment, the printing press is driven and the adjustment is found to be unsuccessful, the printing press must be shut down and adjusted again, thus posing the problem of taking time.

SUMMARY OF THE INVENTION

The present invention has been accomplished in light of the above-described problems with the earlier technologies. Its object is to provide an oscillation amount adjusting device for an oscillating roller, which can make adjustment in a semiautomatic manner using a motor or the like while achieving space saving without exerting adverse influence on printing.

To attain the above object, there is provided, according to an aspect of the present invention, an oscillation amount adjusting device for an oscillating roller in an oscillating roller swing device, the oscillating roller swing device including an oscillating roller swung in an axial direction, a rotating shaft rotatably supported by a frame and having an inclined shaft portion inclined to an axis of the oscillating roller, a cylindrical sleeve rotatably fitted on the inclined shaft portion of the rotating shaft and having an outer peripheral surface inclined to an axis of the inclined shaft portion, sleeve locking-release means for rendering the sleeve nonrotatable or rotatable relative to the rotating shaft, an oscillating roller engagement member rotatably supported on the sleeve and having a first engagement portion engaging the oscillating roller, and drive means for rotating the rotating shaft, the oscillation amount adjusting device, comprising:

a second engagement portion provided in the sleeve; and restraining means for engaging the second engagement portion to restrain rotation of the sleeve, wherein the sleeve locking-release means is brought into a release state and the restraining means is brought into engagement with the second engagement portion and, with the release state and the engagement being maintained, the drive means is driven.

Thus, high accuracy adjustment can be made semiautomatically using a motor or the like, so that marked reduction of the working time is achieved. Since the oscillation phases of the respective oscillating rollers are rendered different, moreover, printing is not adversely affected, and simplification of the apparatus results in space saving.

The drive means may be a dedicated motor directly coupled to a shaft end of the rotating shaft.

The drive means may be a drive motor for driving an entire machine, and the drive motor may be connected to the rotating shaft via a gear mechanism.

The oscillation amount adjusting device may further comprise restraining means moving means for moving the restraining means between an engagement position where the restraining means is brought into engagement with the second engagement portion and a retreat position where the restraining means is out of engagement with the second engagement portion.

The oscillation amount adjusting device may further comprise a sleeve rotation position detector for detecting a rotation position of the sleeve, and the second engagement portion may be a groove provided in the sleeve.

The oscillation amount adjusting device may further comprise: an oscillation amount setting device for setting a swing amount of the oscillating roller; a drive amount detector for detecting a drive amount of the drive means; and a control device for controlling the drive means in response to a signal from a sleeve rotation position detector for detecting a rotation position of the sleeve, a signal from the oscillation amount setting device, and a signal from the drive amount detector.

According to another aspect of the present invention, there is provided an oscillation amount adjusting device for an oscillating roller in an oscillating roller swing device, the oscillating roller swing device including an oscillating roller swung in an axial direction, a rotating shaft rotatably supported by a frame and having an inclined shaft portion inclined to an axis of the oscillating roller, a cylindrical sleeve rotatably fitted on the inclined shaft portion of the rotating shaft and having an outer peripheral surface inclined to an axis of the inclined shaft portion, sleeve locking-release means for rendering the sleeve nonrotatable or rotatable relative to the rotating shaft, an oscillating roller engagement member rotatably supported on the sleeve and having a first engagement portion engaging the oscillating roller, and drive means for rotating the sleeve, the oscillation amount adjusting device, comprising:

a second engagement portion provided in the rotating shaft; and restraining means for engaging the second engagement portion to restrain rotation of the rotating shaft, wherein the sleeve locking-release means is brought into a release state and the restraining means is brought into engagement with the second engagement portion and, with the release state and the engagement being maintained, the drive means is driven.

The drive means may be a dedicated motor, and the dedicated motor may be connected to a rotating member via a gear mechanism, the rotating member being detachably fitted on the rotating shaft, being rotatably supported by a support portion, and being nonrotatably engaged with the sleeve.

The drive means may be a dedicated motor, and the dedicated motor may directly rotate the sleeve via a friction wheel, the sleeve nonrotatably engaging a rotating member, the rotating member being detachably fitted on the rotating shaft and being rotatably supported by a support portion.

The oscillation amount adjusting device may further comprise restraining means moving means for moving the restraining means between an engagement position where the restraining means is brought into engagement with the second engagement portion and a retreat position where the restraining means is out of engagement with the second engagement portion.

The oscillation amount adjusting device may further comprise: a rotating shaft rotation position detector for detecting a rotation position of the rotating shaft; an oscillation amount setting device for setting a swing amount of the oscillating roller; a drive amount detector for detecting a drive amount of the drive means; and a control device for controlling the drive means in response to a signal from the rotating shaft rotation position detector, a signal from the oscillation amount setting device, and a signal from the drive amount detector.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a control block diagram;

FIG. 11 is a control block diagram;

DETAILED DESCRIPTION OF THE INVENTION

An oscillation amount adjusting device for an oscillating roller according to the present invention will now be described in detail by embodiments with reference to the accompanying drawings, which in no way limit the invention.

First Embodiment

Figure 1:
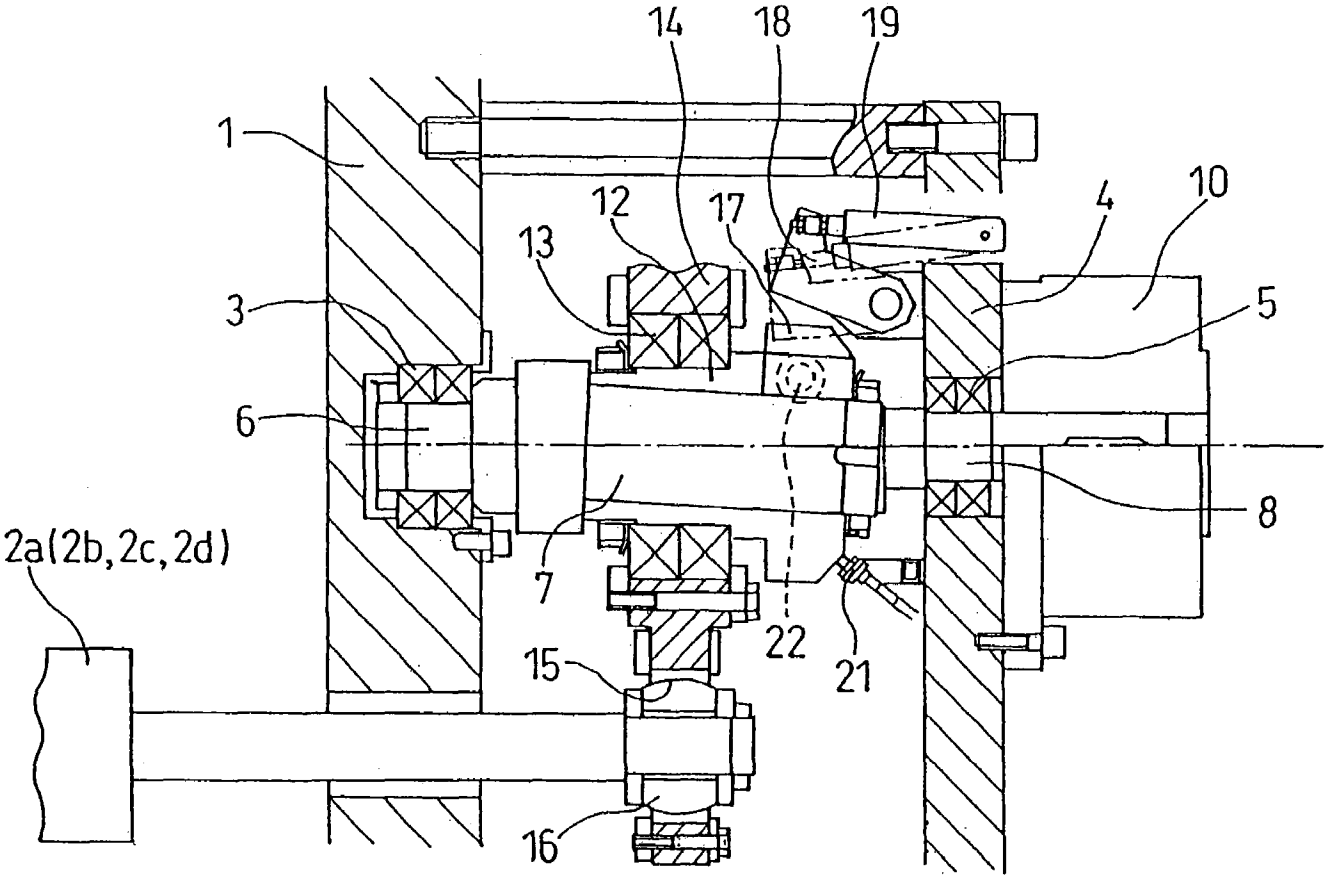
FIG. 1 is a front sectional view of an oscillating roller swing device of an inking device in a printing press, showing a first embodiment of the present invention.
Figure 2:
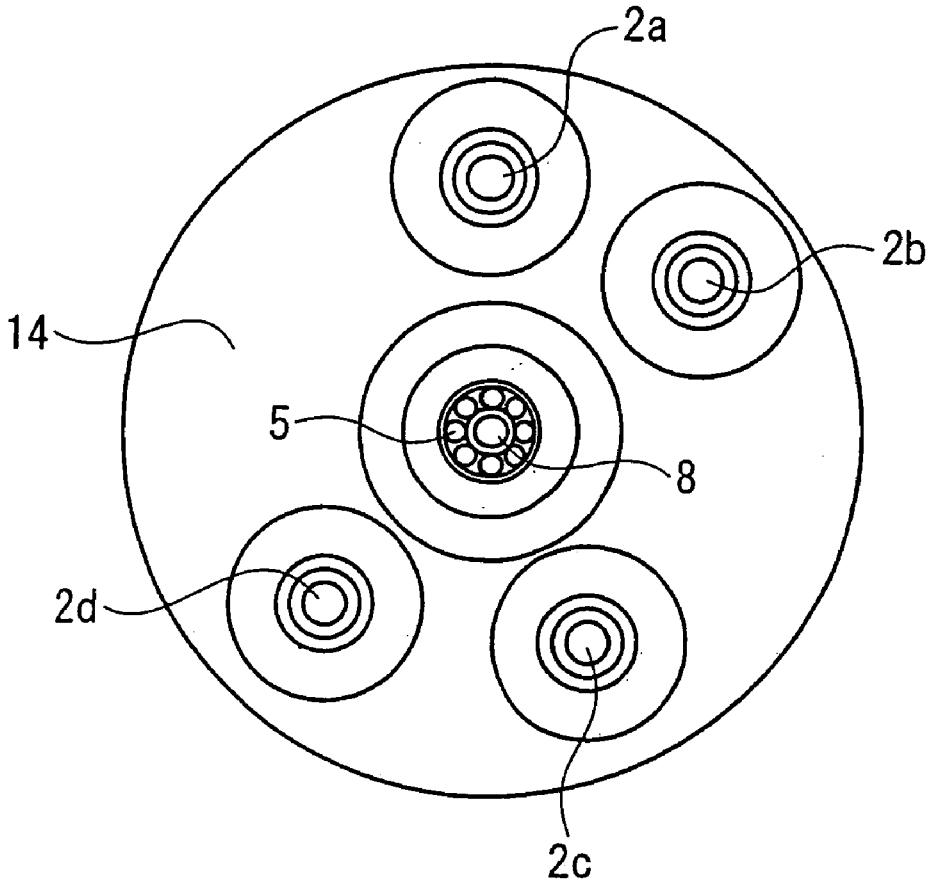
FIG. 2 is a side view of essential parts.
Figure 4:
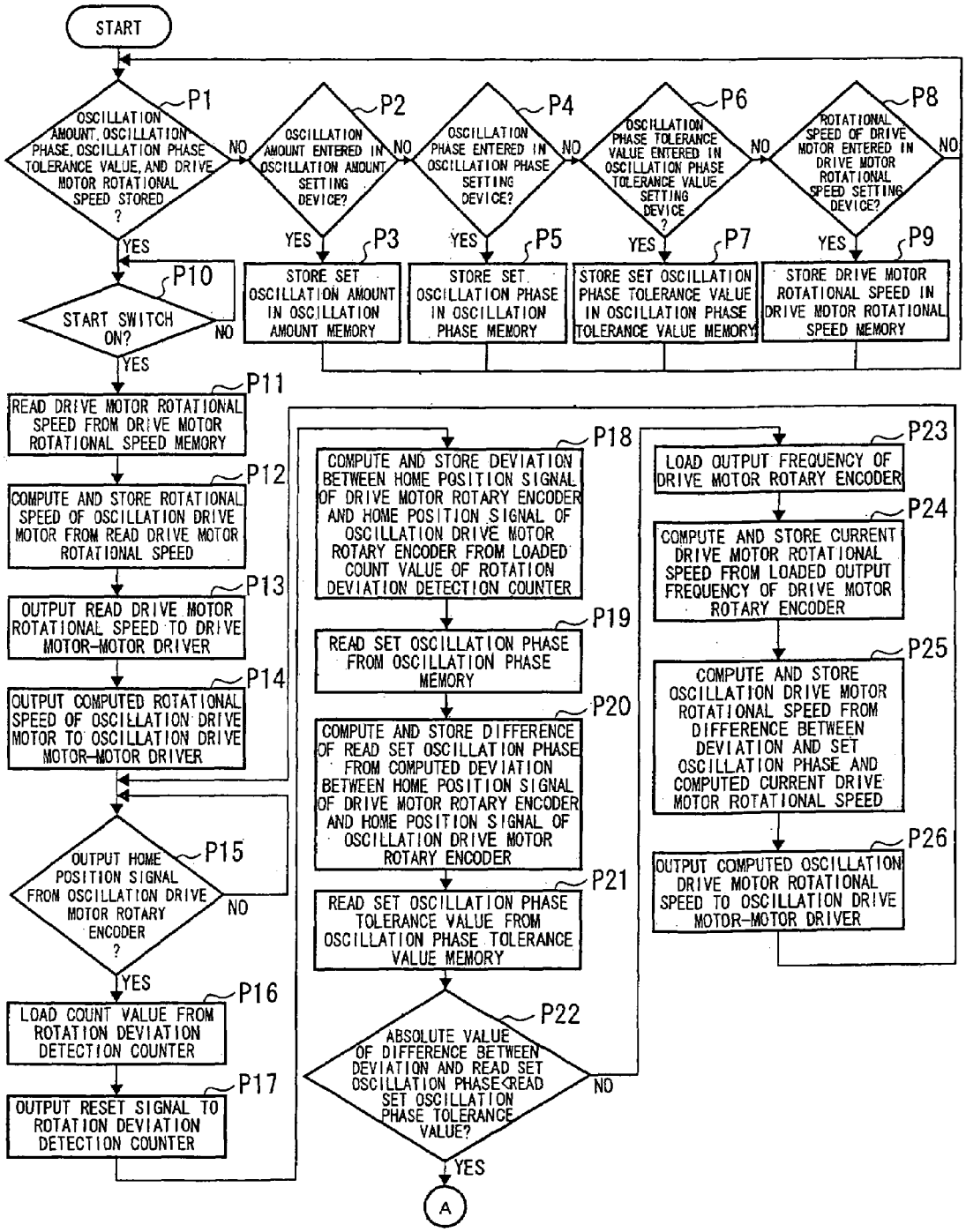
FIG. 4 is a flow chart for oscillation amount control.
Figure 5:
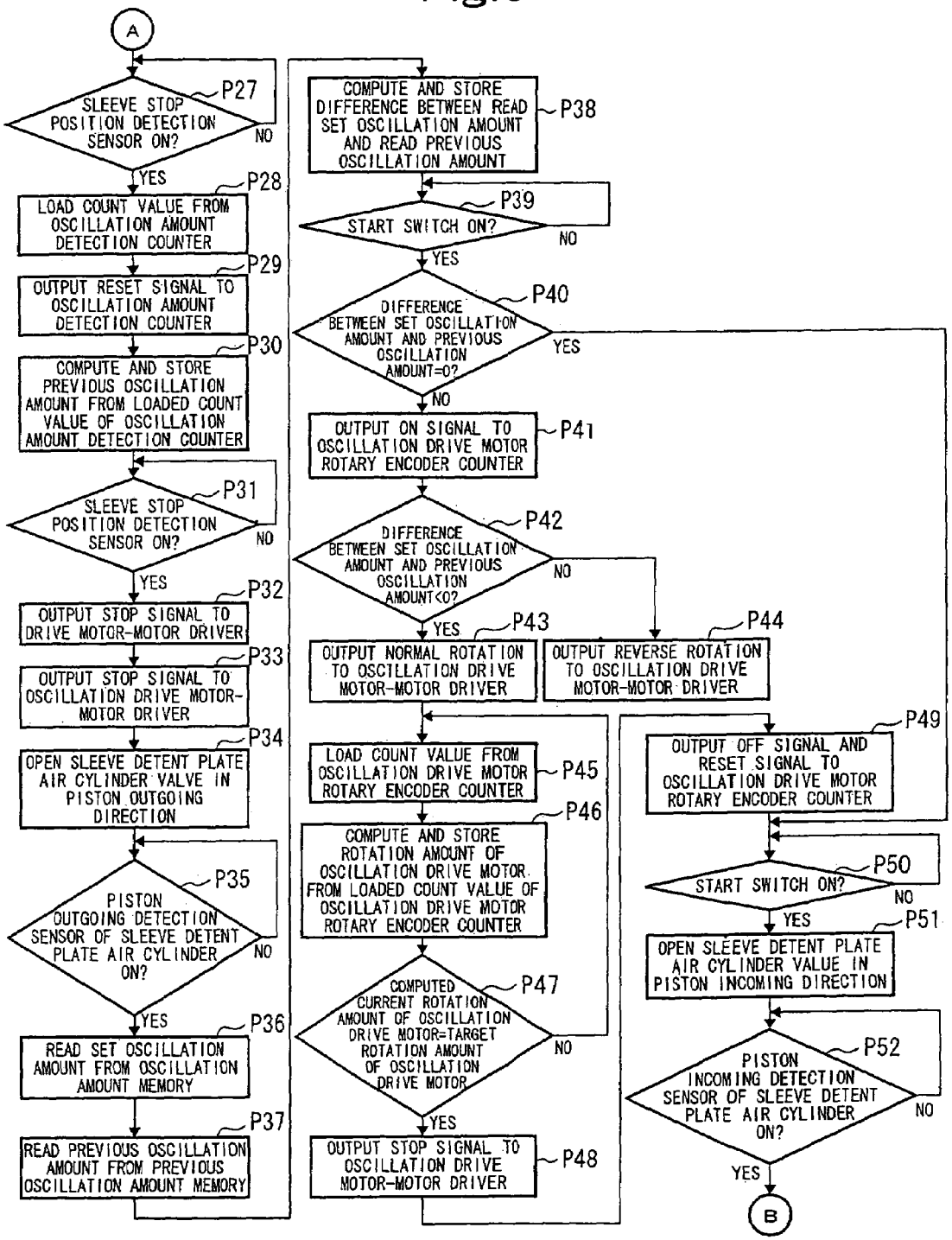
FIG. 5 is a flow chart for the oscillation amount control.
Figure 6:
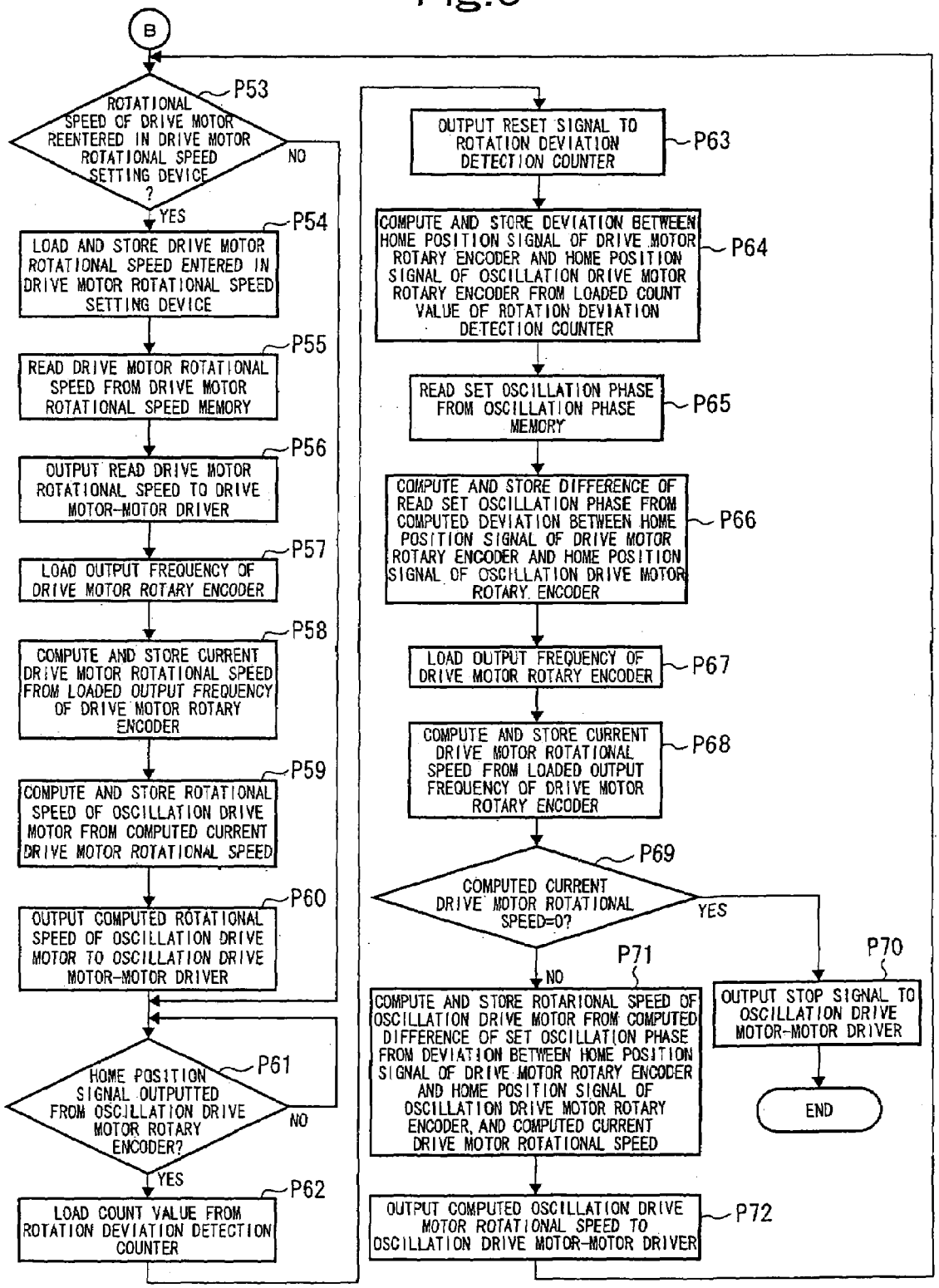
FIG. 6 is a flow chart for the oscillation amount control.

FIG. 1 is a front sectional view of an oscillating roller swing device of an inking device in a printing press, showing a first embodiment of the present invention. FIG. 2 is a side view of essential parts thereof. FIG. 3 is a control block diagram. FIG. 4 is a flow chart for oscillation amount control. FIG. 5 is a flow chart for the oscillation amount control. FIG. 6 is a flow chart for the oscillation amount control.

As shown in FIGS. 1 and 2, four oscillating rollers 2*a*, 2*b*, 2*c*, and 2*d* are journaled by a frame 1 of an inking device. A rotating shaft 6, which is journaled by a bearing 3 provided in the frame 1 and a bearing 5 of a support plate 4 screwed to the frame 1, is provided in a middle portion nearly equally spaced from these oscillating rollers 2*a*, 2*b*, 2*c*, and 2*d*.

The rotating shaft 6 is composed of an inclined shaft portion 7 and a parallel shaft portion 8 located adjacently, the inclined shaft portion 7 being inclined with respect to the axes of the oscillating rollers 2*a*, 2*b*, 2*c*, and 2*d*, and the parallel shaft portion 8 having an axis parallel to the axes of the oscillating rollers 2*a*, 2*b*, 2*c*, and 2*d*. The parallel shaft portion 8 is journaled by the support plate 4, and is also directly coupled to an oscillation drive motor (drive means, a dedicated motor) 10 incorporating a rotary encoder 9 (drive amount detector; see FIG. 3) which comprises a servo motor or the like. The oscillation drive motor 10 is laterally attached to the support plate 4.

A cylindrical sleeve 12, which has an outer peripheral surface inclined with respect to the axis of the inclined shaft portion 7 of the rotating shaft 6, is fitted on the inclined shaft portion 7 to be rotatable and unmovable in the axial direction. A disk (oscillating roller engagement member) 14 is supported on the outer peripheral surface of the sleeve 12 via a bearing 13 to be rotatable and unmovable in the axial direction. A spherical body 16 provided at the shaft end of each of the oscillating rollers 2*a*, 2*b*, 2*c*, and 2*d* is fitted in a spherical bearing (first engagement portion) 15 provided in an outer peripheral portion of the disk 14.

An engagement groove (second engagement portion) 17 is formed in a part of the outer periphery of the sleeve 12. A sleeve detent plate 18 (restraining means), which engages the engagement groove 17, is pivotally supported by the support plate 4. The sleeve 12 is adapted to split-clamp the inclined shaft portion 7, and the sleeve 12 becomes rotatable relative to the inclined shaft portion 7 when a sleeve locking bolt (sleeve locking-release means) 22 is loosened.

An air cylinder (restraining means moving means) 19, which moves the sleeve detent plate 18 between an engagement position (see double-dotted chain lines in FIG. 1), where the sleeve detent plate 18 engages the engagement groove 17, and a retreat position (see solid lines in FIG. 1), where the sleeve detent plate 18 is out of engagement with the engagement groove 17, is assembled to the support plate 4. The air cylinder 19 incorporates a piston outgoing (the above-mentioned engagement position) detection sensor 20*a* and a piston incoming (the above-mentioned retreat position) detection sensor 20*b* (see FIG. 3). A sensor (sleeve rotation position detector) 21 for detecting the stop position of the sleeve 12 on the outer peripheral surface of the sleeve 12 is annexed to the support plate 4.

As shown in FIG. 3, the oscillation drive motor 10 and the air cylinder 19 are driven and controlled by a control device 30A, as is a drive motor 28 for driving the entire printing press, the drive motor 28 incorporating a rotary encoder 27.

The control device 30A comprises CPU, ROM, and RAM, and also includes an oscillation amount memory, an oscillation phase memory, an oscillation phase tolerance value memory, a drive motor rotational speed memory, an oscillation drive motor rotational speed memory, a rotation deviation memory, an oscillation phase difference memory, a drive motor current rotational speed memory, a previous oscillation amount memory, an oscillation drive motor target rotation amount memory, and an oscillation drive motor current rotation amount memory, these memories and input/output devices 31*a* to 31*k*, 31*m*, and 31*n* being connected together by a bus-line BUS.

An input device 32, such as a start switch or a key board, a display device 33 such as a CRT or a display, and an output device 34, such as a printer or a floppy (registered trade mark) disk drive, are connected to the input/output device 31*a*. An oscillation amount setting device 35 for setting the oscillation amount of the oscillating rollers 2*a*, 2*b*, 2*c*, and 2*d*, an oscillation phase setting device 36 for setting the oscillation phases of the oscillating rollers 2*a*, 2*b*, 2*c*, and 2*d*, an oscillation phase tolerance value setting device 46 for setting the oscillation phase tolerance value of the oscillating rollers 2*a*, 2*b*, 2*c*, and 2*d*, and a drive motor rotational speed setting device 37 for setting the rotational speed of the drive motor 28 are connected to the input/output device 31*b*.

The drive motor 28 is connected to the input/output device 31*c* via a drive motor-motor driver 38. The drive motor rotary encoder 27 is connected to the input/output device 31*d* via an F/V converter 39 and an A/D converter 40. A rotation deviation detection counter 41 is connected to the input/output device 31*e*, and the rotation deviation detection counter 41 is connected to the drive motor rotary encoder 27 and the oscillation drive motor rotary encoder (drive amount detector) 9 via a flip-flop circuit 42. Detection signals (clock pulses) from the drive motor rotary encoder (drive amount detector) 27 are entered into the drive motor-motor driver 38 and the rotation deviation detection counter 41.

The rotation deviation detection counter 41, the flip-flop circuit 42, an oscillation amount detection counter 48, and the sleeve stop position detection sensor 21 are connected to the input/output device 31*f*. The oscillation amount detection counter 48 is also connected to the input/output device 31*g*, and the oscillation amount detection counter 48 is further connected to the oscillation drive motor rotary encoder 9 and the sleeve stop position detection sensor 21 via a flip-flop circuit 47. The oscillation amount detection counter 48 and the flip-flop circuit 47 are connected to the oscillation drive motor rotary encoder 9. An oscillation drive motor rotary encoder counter 49 is connected to the input/output device 31*h*, and the oscillation drive motor rotary encoder counter 49 is connected to the oscillation drive motor rotary encoder 9.

The oscillation drive motor rotary encoder counter 49 is also connected to the input/output device 31*i*. The oscillation drive motor rotary encoder 9 is connected to the input/output device 31*j* via an F/V converter 43 and an A/D converter 44. The oscillation drive motor 10 is connected to the input/output device 31*k* via an oscillation drive motor-motor driver 45. The oscillation drive motor-motor driver 45 is connected to the oscillation drive motor rotary encoder 9. A sleeve detent plate air cylinder valve 50 for controlling the sleeve detent plate air cylinder 19 is connected to the input/output device 31*m*. The piston outgoing detection sensor 20*a* and the piston incoming detection sensor 20*b*, which are incorporated in the sleeve detent plate air cylinder 19, are connected to the input/output device 31*n*.

Because of the above-described features, during a routine operation, the oscillation drive motor 10 is rotated, with the sleeve detent plate 18 being located at the retreat position (see the solid lines in FIG. 1) and the sleeve 12 being split-clamped to the rotating shaft 6 by the sleeve locking bolt 22. By this action, the sleeve 12 rotates integrally with the rotating shaft 6 (inclined shaft portion 7), and the oscillatory motion of the inclined shaft portion 7 results in the grinding motion of the disk 14. As a result, the oscillating rollers 2*a*, 2*b*, 2*c*, and 2*d* are each sequentially swung in the axial direction in a different phase and in a predetermined oscillation amount.

In adjusting the oscillation amount of the oscillating rollers 2*a*, 2*b*, 2*c*, 2*d*, a start switch for adjustment is first turned on. Thus, the rotating shaft 6 and the sleeve 12 are rotated in a slower motion by the oscillation drive motor 10. When they arrive at a predetermined stop position (where the engagement groove 17 and the sleeve detent plate 18 align), this arrival is detected by the sensor 21. At this time, their rotation is stopped, and the sleeve detent plate 18 engages the engagement groove 17 to bring the sleeve 12 to a halt.

Then, the operator loosens the sleeve locking bolt 22 to set the sleeve 12 free relative to the rotating shaft 6, and then turns the start switch on to rotate the rotating shaft 6 by a specified amount by the action of the oscillation drive motor 10. Then, the sleeve 12 is fastened to the rotating shaft 6 via the sleeve locking bolt 22 by operator's manipulation. Then, the start switch is turned on. As a result, the sleeve detent plate 18 is released from the engagement groove 17, whereupon the rotating shaft 6 and the sleeve 12 are rotated in synchronism with the printing press, making printing possible. By displacing the rotation phase of the sleeve 12 relative to the rotating shaft 6 in this manner, the oscillation amount of the oscillating rollers 2*a*, 2*b*, 2*c*, and 2*d* is adjusted.

The oscillation amount control of the oscillating rollers 2*a*, 2*b*, 2*c*, and 2*d* explained above will be described in more detail according to flow charts of FIGS. 4 to 6.

In Step P1, it is determined whether the oscillation amount is stored in the oscillation amount memory, whether the oscillation phase is stored in the oscillation phase memory, whether the oscillation phase tolerance value is stored in the oscillation phase tolerance value memory, and whether the drive motor rotational speed is stored in the drive motor rotational speed memory. If these parameters are not stored, it is determined whether the oscillation amount is entered into the oscillation amount setting device 35 in Step P2, whereby the oscillation amount entered into the oscillation amount setting device 35 is loaded and stored in the oscillation amount memory in Step P3 if the oscillation amount has not been entered. Similarly, Step P4 and Step P5 are executed to store the oscillation phase in the oscillation phase memory. Also, Step P6 and Step P7 are executed to store the oscillation phase tolerance value in the oscillation phase tolerance value memory. Moreover, Step P8 and Step P9 are executed to store the drive motor rotational speed in the drive motor rotational speed memory.

If the relevant parameters are determined to have been stored in Step P1, it is determined whether the start switch is turned on in Step P10 to start the oscillation amount control of the oscillating rollers 2*a*, 2*b*, 2*c*, and 2*d*.

If the switch is turned on, then in Step P11, the drive motor rotational speed is read from the drive motor rotational speed memory. Then, in Step P12, the rotational speed of the oscillation drive motor 10 is computed from the drive motor rotational speed read, and the rotational speed of the oscillation drive motor 10 obtained by computation is stored in the oscillation drive motor rotational speed memory. Then, in Step P13, the drive motor rotational speed read is outputted to the drive motor-motor driver 38. In Step P14, the rotational speed of the oscillation drive motor 10 obtained by computation is outputted to the oscillation drive motor-motor driver 45.

Then, in Step P15, if it is determined that a home position signal is outputted from the oscillation drive motor rotary encoder 9, a count value is loaded from the rotation deviation detection counter 41 in Step P16, and then, a reset signal is outputted to the rotation deviation detection counter 41 in Step P17.

Then, in Step P18, a deviation between the home position signal of the drive motor rotary encoder 27 and the home position signal of the oscillation drive motor rotary encoder 9 is computed from the count value loaded above, and the computed deviation is stored in the rotation deviation memory. Then, in Step P19, the set oscillation phase is read from the oscillation phase memory.

Then, in Step P20, the difference between the above deviation obtained by computation—the deviation between the home position signal of the drive motor rotary encoder 27 and the home position signal of the oscillation drive motor rotary encoder 9—and the set oscillation phase read is computed, and stored in the oscillation phase difference memory. Then, in Step P21, the set oscillation phase tolerance value is read from the oscillation phase tolerance value memory.

Then, in Step P22, it is determined whether the absolute value of the difference between the computed deviation—the deviation between the home position signal of the drive motor rotary encoder 27 and the home position signal of the oscillation drive motor rotary encoder 9—and the set oscillation phase read is smaller than the set oscillation phase tolerance value read.

If the absolute value is larger in Step P22, the program shifts to Step P23, in which the output frequency of the drive motor rotary encoder 27 is loaded. In Step P24, the current rotational speed of the drive motor 28 is computed from the output frequency of the drive motor rotary encoder 27 loaded, and is stored in the drive motor current rotational speed memory. Then, in Step 25, the rotational speed of the oscillation drive motor 10 is computed from the difference between the computed deviation—the deviation between the home position signal of the drive motor rotary encoder 27 and the home position signal of the oscillation drive motor rotary encoder 9—and the set oscillation phase, and from the computed current rotational speed of the drive motor 28, and the computed rotational speed of the oscillation drive motor 10 is stored in the rotational speed memory for the oscillation drive motor. Then, in Step P26, the computed rotational speed of the oscillation drive motor 10 is outputted to the oscillation drive motor-motor driver 45, and the program returns to Step P15.

If the absolute value is smaller in Step P22, the program proceeds to Step P27, in which whether the sleeve stop position detection sensor 21 is turned on is determined. In Step P28, the count value is loaded from the oscillation amount detection counter 48, whereafter a reset signal is outputted to the oscillation amount detection counter in Step P29.

Then, in Step P30, the previous oscillation amount is computed from the count value of the oscillation amount detection counter 48 loaded above, and is stored in the previous oscillation amount memory. When it is determined that the sleeve stop position detection sensor 21 is turned on in Step P31, a stop signal is outputted to the drive motor-motor driver 38 in Step P32. Also, in Step P33, a stop signal is outputted to the oscillation drive motor-motor driver 45.

Then, in Step P34, the sleeve detent plate air cylinder valve 50 is opened in the direction of piston outgoing. Then, when it is determined that the piston outgoing detection sensor 20*a* of the sleeve detent plate air cylinder 19 is turned on in Step P35, the set oscillation amount is read from the oscillation amount memory in Step P36.

In Step 37, the previous oscillation amount is read from the previous oscillation amount memory. Then, in Step P38, the difference between the set oscillation amount read and the previous oscillation amount read is computed, and stored in the oscillation drive motor target rotation amount memory. Then, when it is determined that the start switch is turned on in Step P39, it is determined in Step P40 whether the difference between the set oscillation amount and the previous oscillation amount is 0 (zero) or not. If the difference is 0 (zero), the program proceeds to Step P50. If the difference is not 0 (zero), an ON signal is outputted to the oscillation drive motor rotary encoder counter 49 in Step P41. Then, a determination is made in Step P42 as to whether the difference between the set oscillation amount and the previous oscillation amount is smaller than 0 (zero).

If the difference is smaller in Step P42, a normal rotation signal is outputted to the oscillation drive motor-motor driver 45 in Step P43. If the difference is larger in Step P42, a reverse rotation signal is outputted to the oscillation drive motor-motor driver 45 in Step P44. Then, in Step P45, the count value is loaded from the oscillation drive motor rotary encoder counter 49. Then, in Step P46, the rotation amount of the oscillation drive motor 10 is computed from the loaded count value, and stored in the current rotation amount memory for the oscillation drive motor.

Then, in Step P47, it is determined whether the current rotation amount of the oscillation drive motor obtained by computation agrees with the target rotation amount of the oscillation drive motor. If there is no agreement, the program returns to Step P45. If there is agreement, a stop signal is outputted to the oscillation drive motor-motor driver 45 in Step P48.

Then, in Step P49, an OFF signal and a reset signal are outputted to the oscillation drive motor rotary encoder counter 49. Then, if it is determined that the start switch is turned on in Step P50, whereafter the sleeve detent plate air cylinder valve 50 is opened in the direction of piston incoming in Step P51. Then, when the piston incoming detection sensor 20*b* of the sleeve detent plate air cylinder 19 is turned on in Step P52, the program proceeds to Step P53 and terminates oscillation amount control.

In Step P53, it is determined whether the rotational speed of the drive motor 28 has been reentered into the drive motor rotational speed setting device 37. If it has not been reentered, the program shifts to Step P61. If it has been reentered, the drive motor rotational speed entered into the drive motor rotational speed setting device 37 is loaded and stored in the drive motor rotational speed memory in Step P54.

Then, in Step P55, the drive motor rotational speed is read from the drive motor rotational speed memory, whereafter the read drive motor rotational speed is outputted to the drive motor-motor driver 38 in Step P56. Then, the output frequency of the drive motor rotary encoder 27 is loaded in Step P57. Then, in Step P58, the current rotational speed of the drive motor 28 is computed from the output frequency of the drive motor rotary encoder 27 loaded above, and is stored in the current rotational speed memory for the drive motor.

Then, in Step P59, the rotational speed of the oscillation drive motor 10 is computed from the current rotational speed of the drive motor obtained by computation, and stored in the rotational speed memory for the oscillation drive motor. Then, in Step P60, the rotational speed of the oscillation drive motor 10 obtained by computation is outputted to the oscillation drive motor-motor driver 45, and the program proceeds to Step P61.

Then, when a home position signal is outputted from the oscillation drive motor rotary encoder 9 in Step P61, the count value is loaded from the rotation deviation detection counter 41 in Step P62. Then, a reset signal is outputted to the rotation deviation detection counter 41 in Step P63.

Then, in Step P64, a deviation between the home position signal of the drive motor rotary encoder 27 and the home position signal of the oscillation drive motor rotary encoder 9 is computed from the count value loaded above, and the computed deviation is stored in the rotation deviation memory. Then, in Step P65, the set oscillation phase is read from the oscillation phase memory.

Then, in Step P66, the difference between the above deviation obtained by computation, i.e., the deviation between the home position signal of the drive motor rotary encoder 27 and the home position signal of the oscillation drive motor rotary encoder 9, and the set oscillation phase read above is computed, and stored in the oscillation phase difference memory. Then, in Step P67, the output frequency of the drive motor rotary encoder 27 is loaded.

Then, in Step P68, the current rotational speed of the drive motor 28 is computed from the output frequency of the drive motor rotary encoder 27 loaded above, and is stored in the drive motor current rotational speed memory. Then, in Step 69, it is determined whether the current rotational speed of the drive motor 28 obtained by computation is 0 (zero). If it is 0, a stop signal is outputted to the oscillation drive motor-motor driver 45 in Step P70 to terminate oscillation phase control.

If the rotational speed is not 0 in Step P69, the rotational speed of the oscillation drive motor 10 is computed in Step P71 from the difference between the deviation obtained by computation—the deviation between the home position signal of the drive motor rotary encoder 27 and the home position signal of the oscillation drive motor rotary encoder 9—and the set oscillation phase, and from the current rotational speed of the drive motor 28 obtained by computation, and is stored in the oscillation drive motor rotational speed memory. Then, in Step P72, the rotational speed of the oscillation drive motor 10 obtained by computation is outputted to the oscillation drive motor-motor driver 45, and the program returns to Step P53 to continue oscillation phase control.

In the present embodiment, as described above, the sleeve detent plate 18 for restraining the rotation of the sleeve 12 is provided, and the operator manually loosens the sleeve locking bolt 22, enabling the sleeve 12 to be rotated relative to the rotating shaft 6 which supports the sleeve 12. Moreover, the rotation of the sleeve 12 is restrained by the sleeve detent plate 18 and, in this state, the rotating shaft 6 supporting the sleeve 12 is rotated by the oscillation drive motor 10 to adjust the oscillation amount of the oscillating rollers 2*a*, 2*b*, 2*c*, 2*d*. Thus, oscillation amount adjustment can be made semiautomatically with high accuracy using a motor or the like, whereby marked reduction of the working time is achieved.

During a routine operation, moreover, the disk 14 makes a grinding motion upon the oscillatory motion of the inclined shaft portion 7. Thus, the oscillating rollers 2*a*, 2*b*, 2*c*, 2*d* swing in the axial direction. At this time, the oscillating rollers 2*a*, 2*b*, 2*c*, 2*d* swing sequentially in shifted phases in accordance with the order of their arrangement. As a result, their ink distribution is performed in different phases, and their swing takes place individually, so that high quality printing free from shock can be done. In addition, the oscillation mechanism is compact, thus ensuring space saving.

Second Embodiment

Figure 7:
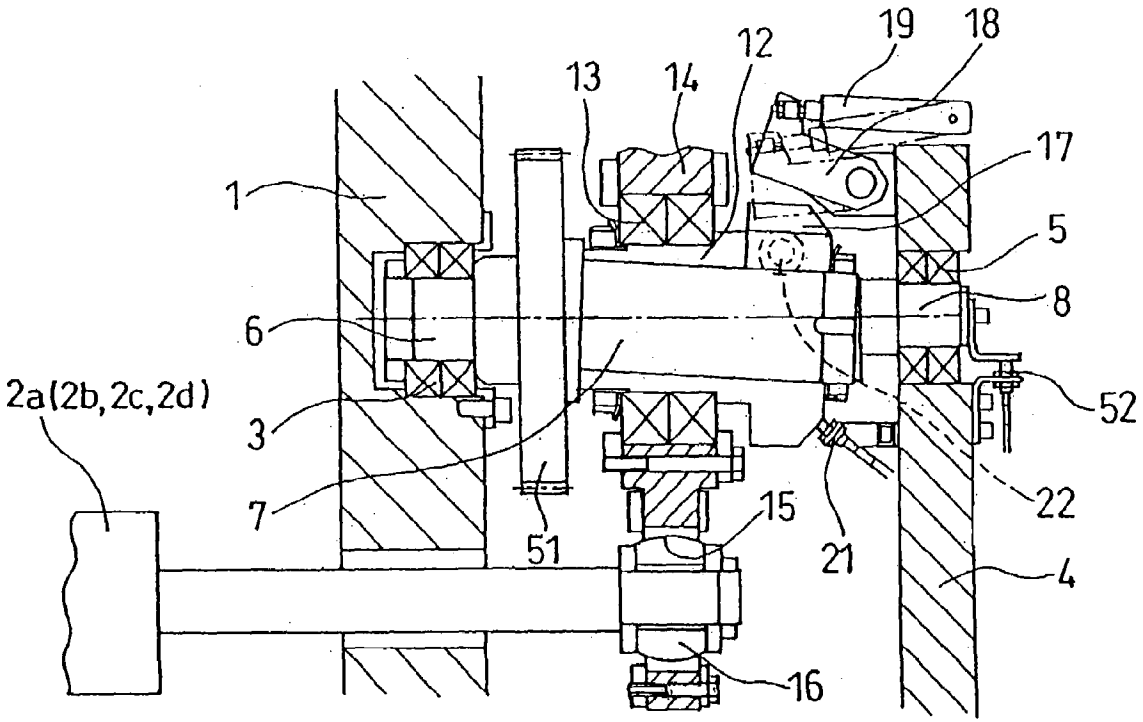
FIG. 7 is a front sectional view of an oscillating roller swing device of an inking device in a printing press, showing a second embodiment of the present invention.
Figure 8:
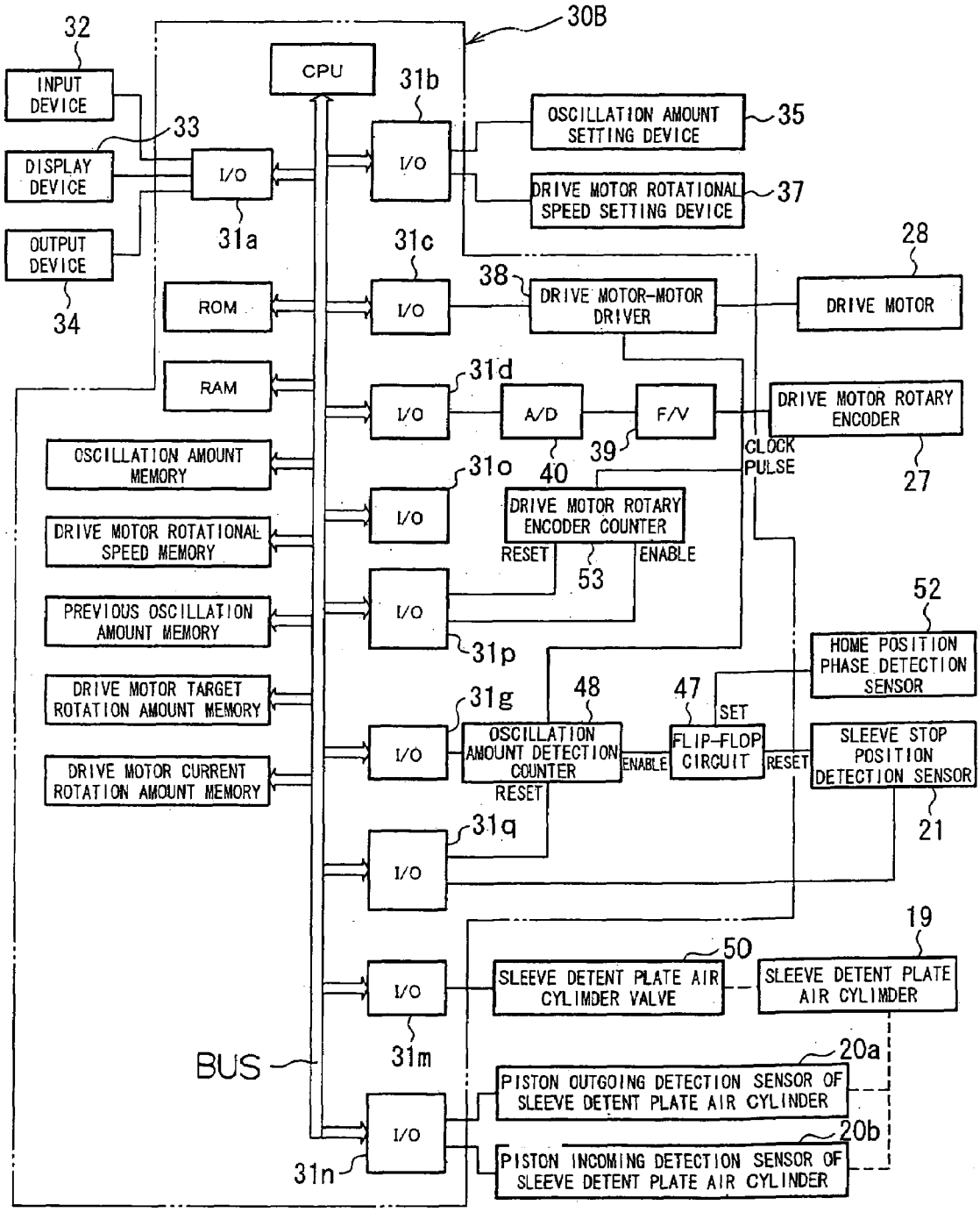
FIG. 8 is a control block diagram.
Figure 9:
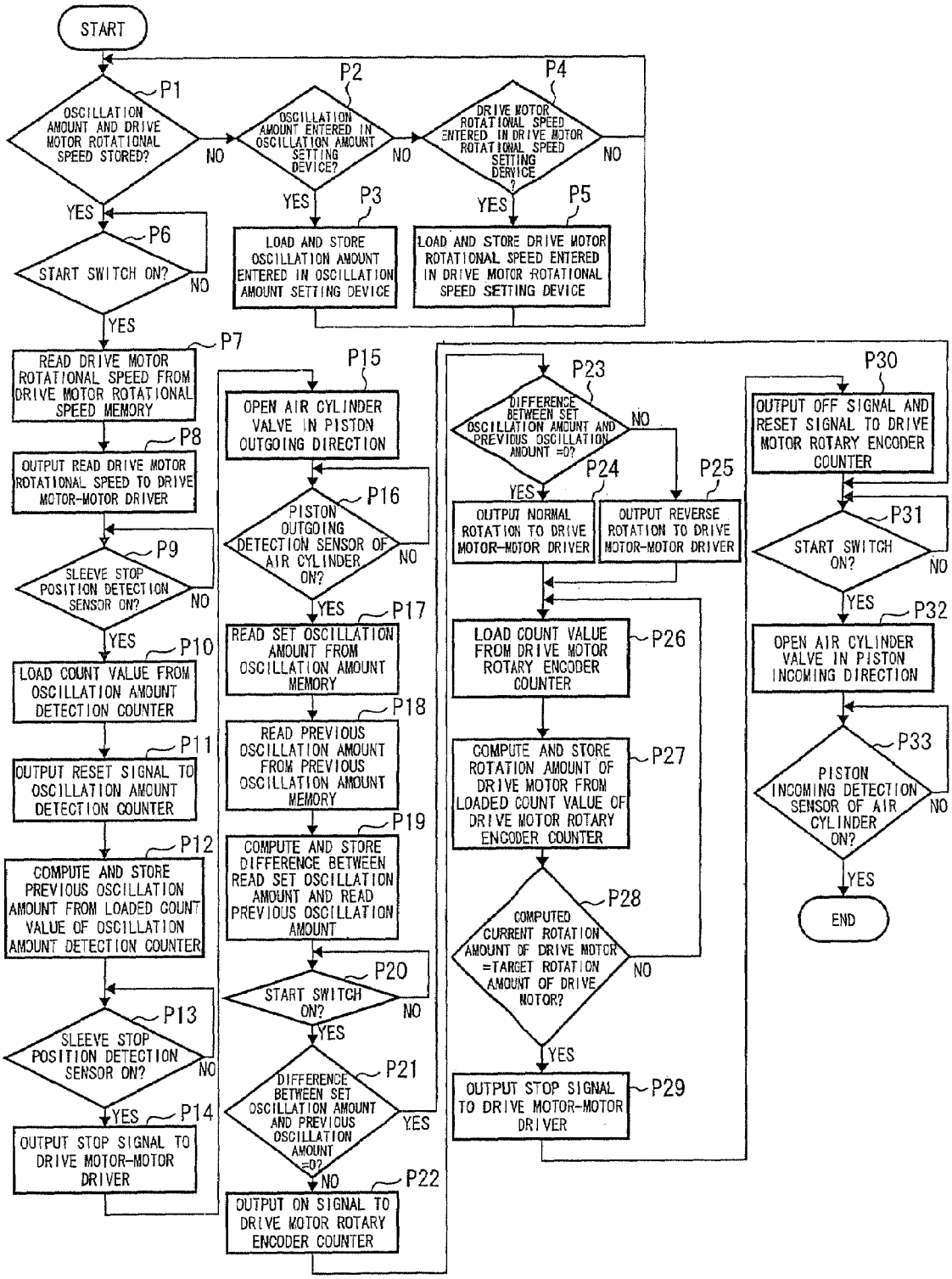
FIG. 9 is a flow chart for oscillation amount control.

FIG. 7 is a front sectional view of an oscillating roller swing device of an inking device in a printing press, showing a second embodiment of the present invention. FIG. 8 is a control block diagram. FIG. 9 is a flow chart for oscillation amount control.

This embodiment is an embodiment in which the rotating shaft 6, which supports the sleeve 12 in the First Embodiment rotatably at the inclined shaft portion 7, is rotated and driven via a gear 51 by the drive motor 28 for driving the entire printing press, and a home position phase detection sensor 52, such as an optical sensor, for detecting a phase home position reference at the parallel shaft portion 8 of the rotating shaft 6 is annexed to the support plate 4. Other features are the same as those in the First Embodiment.

The drive motor 28 and the air cylinder 19 are driven and controlled by a control device 30B, as shown in FIG. 8.

The control device 30B comprises CPU, ROM, and RAM, and also includes an oscillation amount memory, a drive motor rotational speed memory, a previous oscillation amount memory, a drive motor target rotation amount memory, and a drive motor current rotation amount memory, these memories and input/output devices 31*a* to 31*d*, 31*o* to 31*q*, 31*g*, 31*m* and 31*n* being connected by a bus-line BUS.

An input device 32, such as a start switch or a key board, a display device 33 such as a CRT or a display, and an output device 34, such as a printer or a floppy disk drive, are connected to the input/output device 31*a*. An oscillation amount setting device 35 for setting the oscillation amount of the oscillating rollers 2*a*, 2*b*, 2*c*, and 2*d*, and a drive motor rotational speed setting device 37 for setting the rotational speed of the drive motor 28 are connected to the input/output device 31*b*.

The drive motor 28 is connected to the input/output device 31*c* via a drive motor-motor driver 38. A drive motor rotary encoder 27 is connected to the input/output device 31*d* via an F/V converter 39 and an A/D converter 40. A drive motor rotary encoder counter 53 is connected to the input/output device 31*o*, and the drive motor rotary encoder counter 53 is connected to the drive motor rotary encoder 27. The drive motor rotary encoder counter 53 is also connected to the input/output device 31*p*.

An oscillation amount detection counter 48 is connected to the input/output device 31*g*, and the oscillation amount detection counter 48 is also connected to a sleeve stop position detection sensor 21 and the home position phase detection sensor 52 via a flip-flop circuit 47. The oscillation amount detection counter 48 is connected to the drive motor rotary encoder (drive amount detector) 27. The oscillation amount detection counter 48 and the sleeve stop position detection sensor 21 are connected to the input/output device 31*q*.

A sleeve detent plate air cylinder valve 50 for controlling the sleeve detent plate air cylinder 19 is connected to the input/output device 31*m*. The piston outgoing detection sensor 20*a* and the piston incoming detection sensor 20*b*, which are incorporated in the sleeve detent plate air cylinder 19, are connected to the input/output device 31*n*.

Next, the oscillation amount control of the oscillating rollers 2*a*, 2*b*, 2*c*, and 2*d* in the oscillating roller swing device configured above will be described in detail according to a flow chart of FIG. 9.

In Step P1, it is determined whether the oscillation amount is stored in the oscillation amount memory, and whether the drive motor rotational speed is stored in the drive motor rotational speed memory. If these parameters are not stored, it is determined whether the oscillation amount is entered into the oscillation amount setting device 35 in Step P2, whereby the oscillation amount entered into the oscillation amount setting device 35 is loaded, and stored in the oscillation amount memory in Step P3 if the oscillation amount has not been entered. Similarly, Step P4 and Step P5 are executed to store the drive motor rotational speed in the drive motor rotational speed memory.

If the relevant parameters are stored in Step P1, it is determined whether the start switch is turned on in Step P6 to start the oscillation amount control of the oscillating rollers 2*a*, 2*b*, 2*c*, and 2*d*.

Then, in Step P7, the drive motor rotational speed is read from the drive motor rotational speed memory. Then, in Step P8, the drive motor rotational speed read is outputted to the drive motor-motor driver 38.

When it is determined that the sleeve stop position detection sensor 21 is turned on in Step P9, the count value is loaded from the oscillation amount detection counter 48 in Step P10, whereafter a reset signal is outputted to the oscillation amount detection counter 48 in Step P11.

Then, in Step P12, the previous oscillation amount is computed from the count value loaded above, and is stored in the previous oscillation amount memory. When it is determined that the sleeve stop position detection sensor 21 is turned on in Step P13, a stop signal is outputted to the drive motor-motor driver 38 in Step P14.

Then, in Step P15, the sleeve detent plate air cylinder valve 50 is opened in the direction of piston outgoing. Then, when it is determined that the piston outgoing detection sensor 20*a* of the sleeve detent plate air cylinder 19 is turned on in Step P16, the set oscillation amount is read from the oscillation amount memory in Step P17.

In Step 18, the previous oscillation amount is read from the previous oscillation amount memory. Then, in Step P19, the difference between the set oscillation amount read and the previous oscillation amount read is computed, and stored in the drive motor target rotation amount memory. Then, when it is determined that the start switch is turned on in Step P20, it is determined in Step P21 whether the difference between the set oscillation amount and the previous oscillation amount is 0 (zero) or not. If the difference is 0 (zero), the program proceeds to Step P31. If the difference is not 0 (zero), an ON signal is outputted to the drive motor rotary encoder counter 53 in Step P22. Then, a determination is made in Step P23 as to whether the difference between the set oscillation amount and the previous oscillation amount is smaller than 0 (zero).

If the difference is smaller in Step P23, a normal rotation signal is outputted to the drive motor-motor driver 38 in Step P24. If the difference is larger in Step P23, a reverse rotation signal is outputted to the drive motor-motor driver 38 in Step P25. Then, in Step P26, the count value is loaded from the drive motor rotary encoder counter 53. Then, in Step P27, the rotation amount of the drive motor 28 is computed from the loaded count value, and stored in the current rotation amount memory for the drive motor.

Then, in Step P28, it is determined whether the current rotation amount of the drive motor obtained by computation agrees with the target rotation amount of the drive motor. If there is no agreement, the program returns to Step P26. If there is agreement, a stop signal is outputted to the drive motor-motor driver 38 in Step P29.

Then, in Step P30, an OFF signal and a reset signal are outputted to the drive motor rotary encoder counter 53. Then, when it is determined that the start switch is turned on in Step P31, the sleeve detent plate air cylinder valve 50 is opened in the direction of piston incoming in Step P32. Then, when it is determined that the piston incoming detection sensor 20*b* of the sleeve detent plate air cylinder 19 is turned on in Step P33, oscillation amount control is terminated.

According to the present embodiment, as described above, the oscillation amount of the oscillating rollers 2*a*, 2*b*, 2*c*, 2*d* can be adjusted semiautomatically by use of the drive motor 28, and the same actions and effects as in the First Embodiment are obtained. In addition, the present embodiment does not use a dedicated oscillation drive motor, so that simplification of the apparatus and cost reduction are achieved.

Third Embodiment

Figure 10:
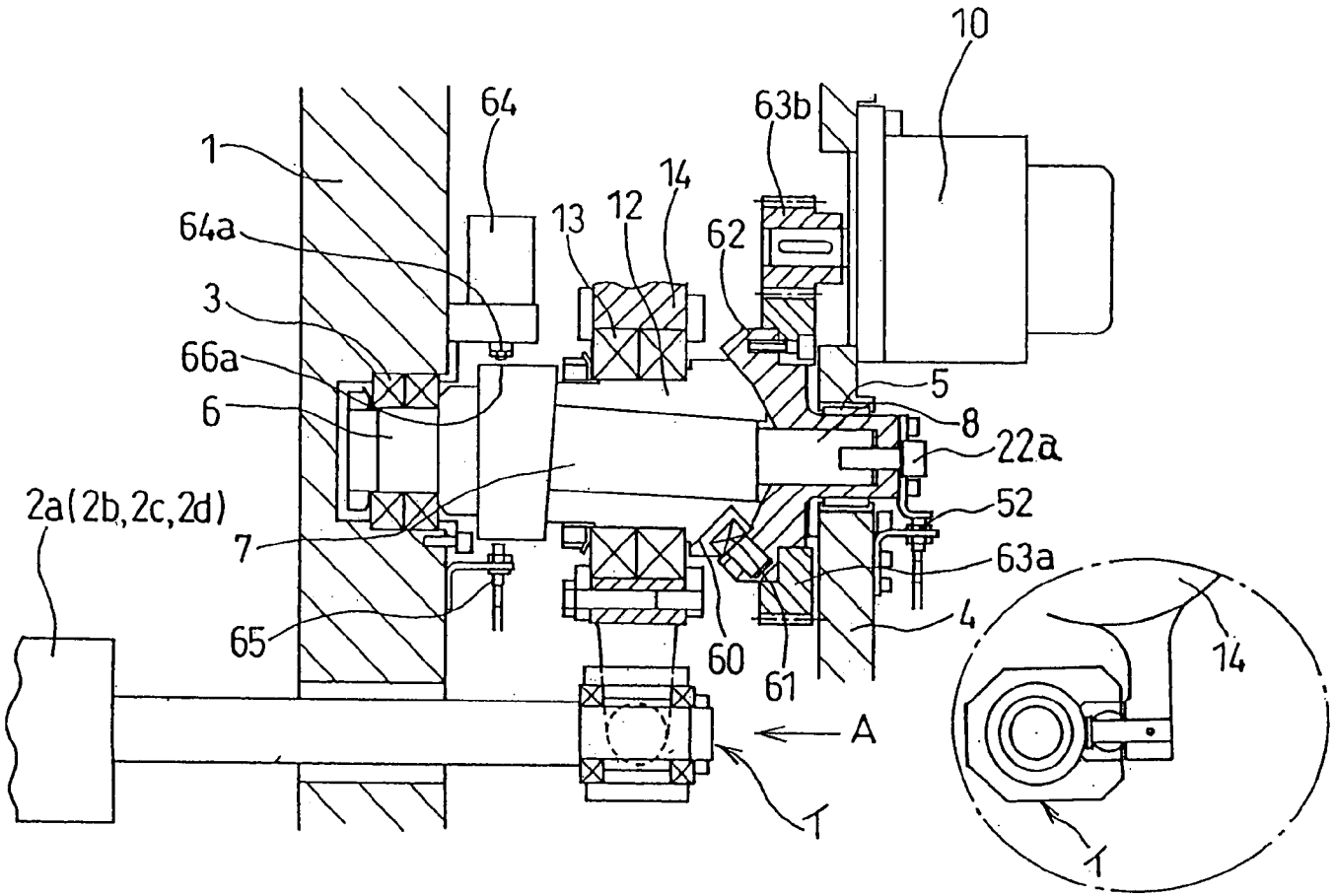
FIG. 10 is a front sectional view of an oscillating roller swing device of an inking device in a printing press, showing a third embodiment of the present invention.
Figure 12:
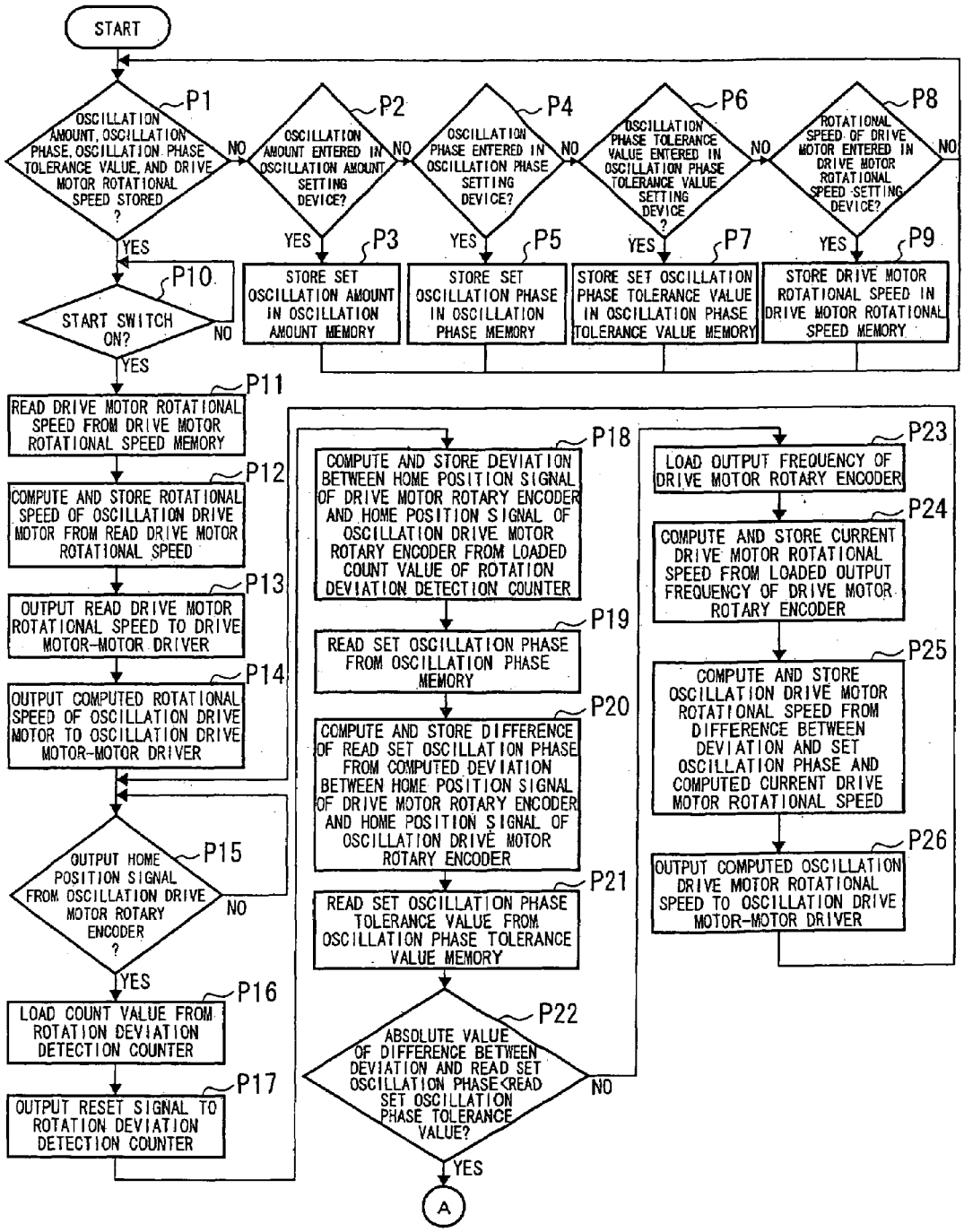
FIG. 12 is a flow chart for oscillation amount control.
Figure 13:
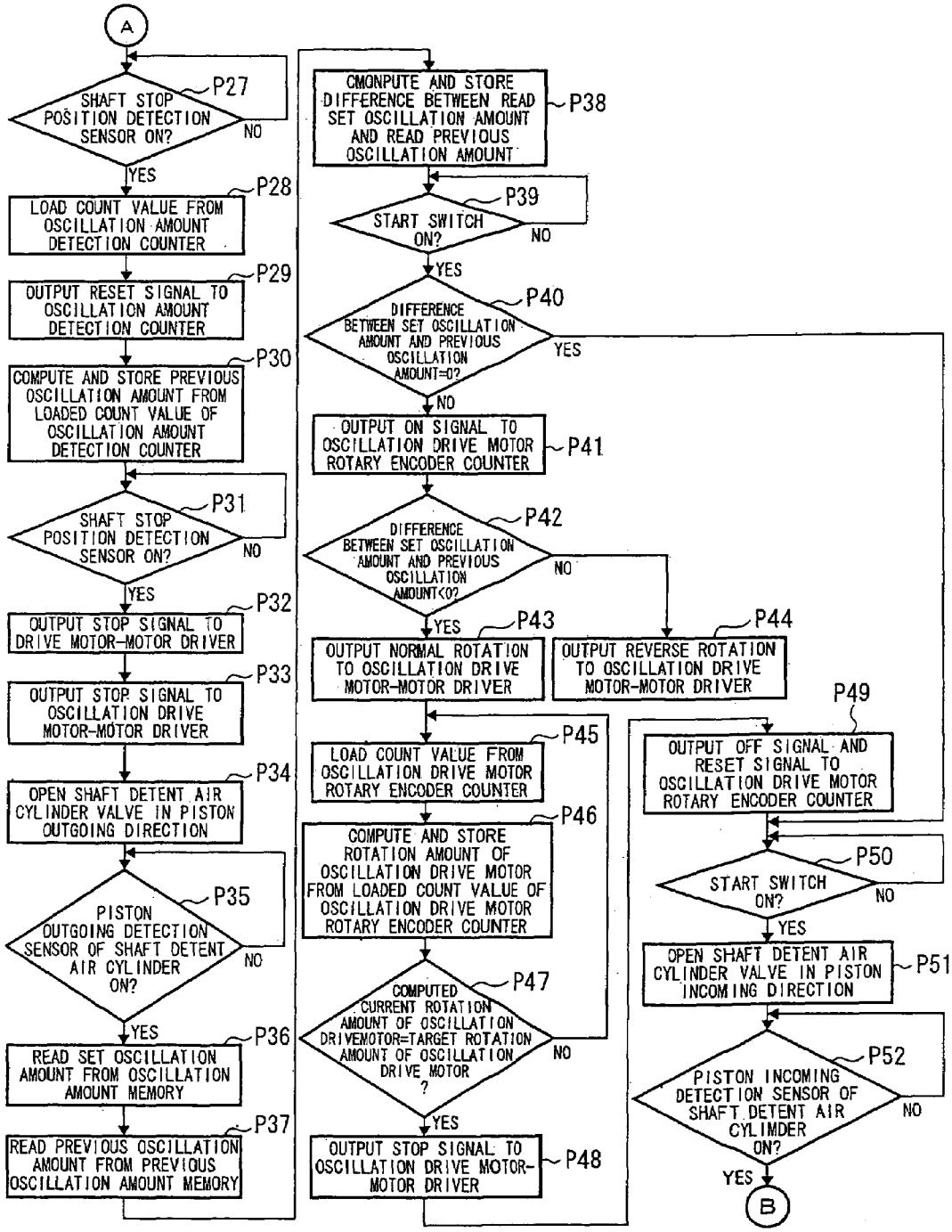
FIG. 13 is a flow chart for the oscillation amount control.
Figure 14:
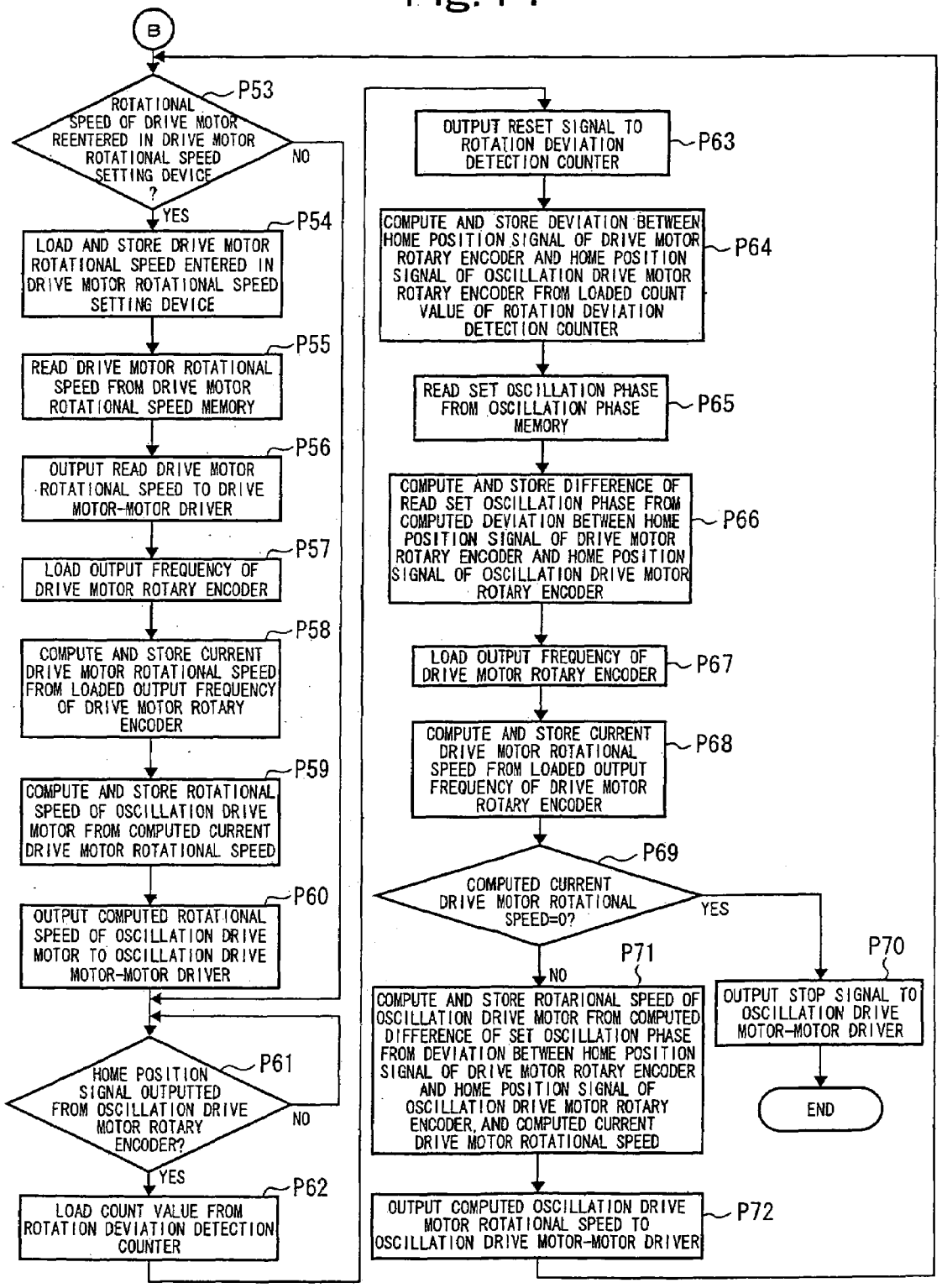
FIG. 14 is a flow chart for the oscillation amount control.

FIG. 10 is a front sectional view of an oscillating roller swing device of an inking device in a printing press, showing a third embodiment of the present invention. FIG. 11 is a control block diagram. FIG. 12 is a flow chart for oscillation amount control. FIG. 13 is a flow chart for the oscillation amount control. FIG. 14 is a flow chart for the oscillation amount control.

As shown in FIG. 10, four oscillating rollers 2*a*, 2*b*, 2*c*, and 2*d* are journaled by a frame 1 of an inking device. A rotating shaft 6, which is journaled by a bearing 3 provided in the frame 1 and a bearing 5 of a support plate 4 screwed to the frame 1, is provided in a middle portion nearly equally spaced from these oscillating rollers 2*a*, 2*b*, 2*c*, and 2*d*.

The rotating shaft 6 comprises an inclined shaft portion 7 and a parallel shaft portion 8 located adjacently, the inclined shaft portion 7 being inclined with respect to the axes of the oscillating rollers 2*a*, 2*b*, 2*c*, and 2*d*, and the parallel shaft portion 8 having an axis parallel to the axes of the oscillating rollers 2*a*, 2*b*, 2*c*, and 2*d*. The parallel shaft portion 8 is journaled by the support plate (support portion) 4 via a rotating member 62, and is rotationally driven by an oscillation drive motor (drive means, a dedicated motor) 10 incorporating a rotary encoder (drive amount detector; see FIG. 3) 9 which comprises a servo motor or the like.

That is, the rotating member 62 is screwed to the parallel shaft portion 8 by a shaft locking bolt 22*a*, and is engaged with a sleeve 12 (to be described later) via a fitting groove 60 formed in the sleeve 12 and a fitting protrusion 61 annexed to the rotating member 62. A gear 63*a* is screwed to the outer periphery of the rotating member 62, and the gear 63*a* meshes with a gear 63*b* secured to an output shaft of the oscillation drive motor 10 mounted laterally on the support plate 4.

The above-mentioned sleeve 12 of a cylindrical shape, which has an outer peripheral surface inclined with respect to the axis of the inclined shaft portion 7 of the rotating shaft 6, is fitted on the inclined shaft portion 7 to be rotatable and unmovable in the axial direction. A disk (oscillating roller engagement member) 14 is supported on the outer peripheral surface of the sleeve 12 via a bearing 13 to be rotatable and unmovable in the axial direction. Each of the shaft ends of the oscillating rollers 2*a*, 2*b*, 2*c*, 2*d* is rotatably supported by a shaft support portion (a first engagement portion; indicated by the katakana letter イ) provided in an outer peripheral portion of the disk 14. The shaft support portion イ adopts a bearing and a spherical plain bearing, but may adopt a cam follower and a sheave or other structure.

A pressure engagement portion (second engagement portion) 66*a* is provided in a part of the outer periphery of the rotating shaft 6. A shaft detent air cylinder (restraining means, restraining means moving means) 64, which engages the pressure engagement portion 66*a* via a piston rod tip 64*a*, is mounted on the frame 1 longitudinally. The shaft detent air cylinder 64 incorporates a piston outgoing detection sensor 68*a* and a piston incoming detection sensor 68*b* (see FIG. 11). A shaft stop position detection sensor (rotating shaft rotation position detector) 65 for detecting the stop position of the rotating shaft 6 on the outer peripheral surface of the rotating shaft 6 is annexed to the frame 1. A home position phase detection sensor 52, such as an optical sensor, for detecting the phase home position reference in the parallel shaft portion 8 of the rotating shaft 6 (strictly, the shaft portion of the rotating member 62) is annexed to the support plate 4.

As shown in FIG. 11, the oscillation drive motor 10 and the shaft detent air cylinder 64 are driven and controlled by a control device 30C, as is a drive motor 28 for driving the entire printing press, the drive motor 28 incorporating a rotary encoder 27.

The control device 30C comprises CPU, ROM, and RAM, and also includes an oscillation amount memory, an oscillation phase memory, an oscillation phase tolerance value memory, a drive motor rotational speed memory, an oscillation drive motor rotational speed memory, a rotation deviation memory, an oscillation phase difference memory, a drive motor current rotational speed memory, a previous oscillation amount memory, an oscillation drive motor target rotation amount memory, and an oscillation drive motor current rotation amount memory, these memories and input/output devices 31*a* to 31*k*, 31*m*, and 31*n* being connected together by a bus-line BUS.

An input device 32, such as a start switch or a key board, a display device 33 such as a CRT or a display, and an output device 34, such as a printer or a floppy disk drive, are connected to the input/output device 31*a*. An oscillation amount setting device 35 for setting the oscillation amount of the oscillating rollers 2*a*, 2*b*, 2*c*, and 2*d*, an oscillation phase setting device 36 for setting the oscillation phases of the oscillating rollers 2*a*, 2*b*, 2*c*, and 2*d*, an oscillation phase tolerance value setting device 46 for setting the oscillation phase tolerance value of the oscillating rollers 2*a*, 2*b*, 2*c*, and 2*d*, and a drive motor rotational speed setting device 37 for setting the rotational speed of the drive motor 28 are connected to the input/output device 31*b*.

The drive motor 28 is connected to the input/output device 31*c* via a drive motor-motor driver 38. A drive motor rotary encoder 27 is connected to the input/output device 31*d* via an F/V converter 39 and an A/D converter 40. A rotation deviation detection counter 41 is connected to the input/output device 31*e*, and the rotation deviation detection counter 41 is connected to the drive motor rotary encoder 27 and an oscillation drive motor rotary encoder 9 via a flip-flop circuit 42. Detection signals (clock pulses) from the drive motor rotary encoder 27 are entered into the drive motor-motor driver 38 and the rotation deviation detection counter 41.

The rotation deviation detection counter 41, the flip-flop circuit 42, the shaft stop position detection sensor 65, and an oscillation amount detection counter 48 are connected to the input/output device 31*f*. The oscillation amount detection counter 48 is also connected to the input/output device 31*g*, and the oscillation amount detection counter 48 is further connected to the home position phase detection sensor 52 and the shaft stop position detection sensor 65 via a flip-flop circuit 47. The oscillation amount detection counter 48 is also connected to the oscillation drive motor rotary encoder 9. An oscillation drive motor rotary encoder counter 49 is connected to the input/output device 31*h*, and the oscillation drive motor rotary encoder counter 49 is connected to the oscillation drive motor rotary encoder 9.

The oscillation drive motor rotary encoder counter 49 is also connected to the input/output device 31*i*. The oscillation drive motor rotary encoder 9 is connected to the input/output device 31*j* via an F/V converter 43 and an A/D converter 44. The oscillation drive motor 10 is connected to the input/output device 31*k* via an oscillation drive motor-motor driver 45. The oscillation drive motor-motor driver 45 is connected to the oscillation drive motor rotary encoder 9. A shaft detent air cylinder valve 69 for controlling the shaft detent air cylinder 64 is connected to the input/output device 31*m*. The piston outgoing detection sensor 68*a* and the piston incoming detection sensor 68*b*, which are incorporated in the shaft detent air cylinder 64, are connected to the input/output device 31*n*.

Because of the above-described features, during a routine operation, the oscillation drive motor 10 is rotated, with the shaft detent air cylinder 64 being contracted to release the engagement of the piston rod tip 64*a* with the pressure engagement portion 66*a* of the rotating shaft 6, and with the rotating member 62 being screwed to the rotating shaft 6 by the shaft locking bolt 22*a*. By this action, the sleeve 12 rotates integrally with the rotating shaft 6 (inclined shaft portion 7), and the oscillatory motion of the inclined shaft portion 7 results in the grinding motion of the disk 14. As a result, the oscillating rollers 2*a*, 2*b*, 2*c*, and 2*d* are each sequentially swung in the axial direction in a different phase and in a predetermined oscillation amount.

In adjusting the oscillation amount of the oscillating rollers 2*a*, 2*b*, 2*c*, 2*d*, a start switch for adjustment is first turned on. Thus, the rotating shaft 6 and the sleeve 12 are rotated in a slower motion by the oscillation drive motor 10. When they arrive at a predetermined stop position (where the pressure engagement portion 66*a* and the piston rod tip 64*a* align), this arrival is detected by the sensor 65. At this time, their rotation is stopped, and the shaft detent air cylinder 64 expands to bring the piston rod tip 64*a* into engagement with the pressure engagement portion 66*a*, thereby bringing the rotating shaft 6 to a halt.

Then, the operator loosens (removes) the shaft locking bolt 22*a* to set the sleeve 12 and the rotating member 62 free relative to the rotating shaft 6, and then turns the start switch on to rotate the sleeve 12 and the rotating member 62 by a specified amount by the action of the oscillation drive motor 10. Then, the sleeve 12 and the rotating member 62 are fastened to the rotating shaft 6 via the shaft locking bolt 22*a* by operator's manipulation. Then, the start switch is turned on. As a result, the shaft detent air cylinder 64 is contracted to detach the piston rod tip 64*a* from the pressure engagement portion 66*a*, whereupon the rotating shaft 6 and the sleeve 12 are rotated in synchronism with the printing press, making printing possible. By displacing the rotation phase of the sleeve 12 relative to the rotating shaft 6 in this manner, the oscillation amount of the oscillating rollers 2*a*, 2*b*, 2*c*, and 2*d* is adjusted.

The oscillation amount control of the oscillating rollers 2*a*, 2*b*, 2*c*, and 2*d* explained above will be described in more detail according to flow charts of FIGS. 12 to 14.

In Step P1, it is determined whether the oscillation amount is stored in the oscillation amount memory, whether the oscillation phase is stored in the oscillation phase memory, whether the oscillation phase tolerance value is stored in the oscillation phase tolerance value memory, and whether the drive motor rotational speed is stored in the drive motor rotational speed memory. If these parameters are not stored, it is determined whether the oscillation amount is entered into the oscillation amount setting device 35 in Step P2, whereby the oscillation amount entered into the oscillation amount setting device 35 is loaded and stored in the oscillation amount memory in Step P3 if the oscillation amount has not been entered. Similarly, Step P4 and Step P5 are executed to store the oscillation phase in the oscillation phase memory. Also, Step P6 and Step P7 are executed to store the oscillation phase tolerance value in the oscillation phase tolerance value memory. Moreover, Step P8 and Step P9 are executed to store the drive motor rotational speed in the drive motor rotational speed memory.

If the relevant parameters are stored in Step P1, the start switch is turned on in Step P10 to start the oscillation amount control of the oscillating rollers 2*a*, 2*b*, 2*c*, and 2*d*.

Then, in Step P11, the drive motor rotational speed is read from the drive motor rotational speed memory. Then, in Step P12, the rotational speed of the oscillation drive motor 10 is computed from the drive motor rotational speed read, and the rotational speed of the oscillation drive motor 10 obtained by computation is stored in the oscillation drive motor rotational speed memory. Then, in Step P13, the drive motor rotational speed read is outputted to the drive motor-motor driver 38. In Step P14, the rotational speed of the oscillation drive motor 10 obtained by computation is outputted to the oscillation drive motor-motor driver 45.

Then, in Step P15, if it is determined that a home position signal is outputted from the oscillation drive motor rotary encoder 9, the count value is loaded from the rotation deviation detection counter 41 in Step P16, and then, a reset signal is outputted to the rotation deviation detection counter 41 in Step P17.

Then, in Step P18, a deviation between the home position signal of the drive motor rotary encoder 27 and the home position signal of the oscillation drive motor rotary encoder 9 is computed from the count value loaded above, and the computed deviation is stored in the rotation deviation memory. Then, in Step P19, the set oscillation phase is read from the oscillation phase memory.

Then, in Step P20, the difference between the above deviation obtained by computation—the deviation between the home position signal of the drive motor rotary encoder 27 and the home position signal of the oscillation drive motor rotary encoder 9—and the set oscillation phase read is computed, and stored in the oscillation phase difference memory. Then, in Step P21, the set oscillation phase tolerance value is read from the oscillation phase tolerance value memory.

Then, in Step P22, it is determined whether the absolute value of the difference between the computed deviation—the deviation between the home position signal of the drive motor rotary encoder 27 and the home position signal of the oscillation drive motor rotary encoder 9—and the set oscillation phase read is smaller than the set oscillation phase tolerance value read.

If the absolute value is larger in Step P22, the program shifts to Step P23, in which the output frequency of the drive motor rotary encoder 27 is loaded. In Step P24, the current rotational speed of the drive motor 28 is computed from the output frequency of the drive motor rotary encoder 27 loaded, and is stored in the drive motor current rotational speed memory. Then, in Step 25, the rotational speed of the oscillation drive motor 10 is computed from the difference between the computed deviation—the deviation between the home position signal of the drive motor rotary encoder 27 and the home position signal of the oscillation drive motor rotary encoder 9—and the set oscillation phase, and from the computed current rotational speed of the drive motor 28, and the computed rotational speed of the oscillation drive motor 10 is stored in the rotational speed memory for the oscillation drive motor. Then, in Step P26, the computed rotational speed of the oscillation drive motor 10 is outputted to the oscillation drive motor-motor driver 45, and the program returns to Step P15.

If it is determined that the absolute value is smaller in Step P22, the program goes to Step P27, in which it is determined whether the shaft stop position detection sensor 65 is turned on. In Step P28, the count value is loaded from the oscillation amount detection counter 48, whereafter a reset signal is outputted to the oscillation amount detection counter in Step P29.

Then, in Step P30, the previous oscillation amount is computed from the count value of the oscillation amount detection counter 48 loaded above, and is stored in the previous oscillation amount memory. When the shaft stop position detection sensor 65 is turned on in Step P31, a stop signal is outputted to the drive motor-motor driver 38 in Step P32. Also, in Step P33, a stop signal is outputted to the oscillation drive motor-motor driver 45.

Then, in Step P34, the shaft detent air cylinder valve 69 is opened in the direction of piston outgoing. Then, when the piston outgoing detection sensor 68*a* of the shaft detent air cylinder 64 is turned on in Step P35, the set oscillation amount is read from the oscillation amount memory in Step P36.

In Step P37, the previous oscillation amount is read from the previous oscillation amount memory. Then, in Step P38, the difference between the set oscillation amount read and the previous oscillation amount read is computed, and stored in the oscillation drive motor target rotation amount memory. Then, when the start switch is turned on in Step P39, it is determined in Step P40 whether the difference between the set oscillation amount and the previous oscillation amount is 0 (zero) or not. If the difference is 0 (zero), the program shifts to Step P50. If the difference is not 0 (zero), an ON signal is outputted to the oscillation drive motor rotary encoder counter 49 in Step P41. Then, a determination is made in Step P42 as to whether the difference between the set oscillation amount and the previous oscillation amount is smaller than 0 (zero).

If the difference is smaller in Step P42, a normal rotation signal is outputted to the oscillation drive motor-motor driver 45 in Step P43. If the difference is larger in Step P42, a reverse rotation signal is outputted to the oscillation drive motor-motor driver 45 in Step P44. Then, in Step P45, the count value is loaded from the oscillation drive motor rotary encoder counter 49. Then, in Step P46, the rotation amount of the oscillation drive motor 10 is computed from the loaded count value, and stored in the current rotation amount memory for the oscillation drive motor.

Then, in Step P47, it is determined whether the current rotation amount of the oscillation drive motor obtained by computation agrees with the target rotation amount of the oscillation drive motor. If there is no agreement, the program returns to Step P45. If there is agreement, a stop signal is outputted to the oscillation drive motor-motor driver 45 in Step P48.

Then, in Step P49, an OFF signal and a reset signal are outputted to the oscillation drive motor rotary encoder counter 49. Then, if it is determined that the start switch is turned on in Step P50, whereafter the shaft detent air cylinder valve 69 is opened in the direction of piston incoming in Step P51. Then, when the piston incoming detection sensor 68*b* of the shaft detent air cylinder 64 is turned on in Step P52, the program proceeds to Step P53 and terminates oscillation amount control.

In Step P53, it is determined whether the rotational speed of the drive motor 28 has been reentered into the drive motor rotational speed setting device 37. If it has not been reentered, the program shifts to Step P61. If it has been reentered, the drive motor rotational speed entered into the drive motor rotational speed setting device 37 is loaded and stored in the drive motor rotational speed memory in Step P54.

Then, in Step P55, the drive motor rotational speed is read from the drive motor rotational speed memory, whereafter the read drive motor rotational speed is outputted to the drive motor-motor driver 38 in Step P56. Then, the output frequency of the drive motor rotary encoder 27 is loaded in Step P57. Then, in Step P58, the current rotational speed of the drive motor 28 is computed from the output frequency of the drive motor rotary encoder 27, and stored in the current rotational speed memory for the drive motor.

Then, in Step P59, the rotational speed of the oscillation drive motor 10 is computed from the current rotational speed of the drive motor obtained by computation, and stored in the rotational speed memory for the oscillation drive motor. Then, in Step P60, the rotational speed of the oscillation drive motor 10 obtained by computation is outputted to the oscillation drive motor-motor driver 45, and the program proceeds to Step P61.

Then, when it is determined that a home position signal is outputted from the oscillation drive motor rotary encoder 9 in Step P61, the count value is loaded from the rotation deviation detection counter 41 in Step P62. Then, a reset signal is outputted to the rotation deviation detection counter 41 in Step P63.

Then, in Step P64, a deviation between the home position signal of the drive motor rotary encoder 27 and the home position signal of the oscillation drive motor rotary encoder 9 is computed from the count value loaded above, and the computed deviation is stored in the rotation deviation memory. Then, in Step P65, the set oscillation phase is read from the oscillation phase memory.

Then, in Step P66, the difference between the above deviation obtained by computation, i.e., the deviation between the home position signal of the drive motor rotary encoder 27 and the home position signal of the oscillation drive motor rotary encoder 9, and the set oscillation phase read is computed, and stored in the oscillation phase difference memory. Then, in Step P67, the output frequency of the drive motor rotary encoder 27 is loaded.

Then, in Step P68, the current rotational speed of the drive motor 28 is computed from the output frequency of the drive motor rotary encoder 27 loaded, and stored in the drive motor current rotational speed memory. Then, in Step 69, it is determined whether the current rotational speed of the drive motor 28 obtained by computation is 0 (zero). If it is 0, a stop signal is outputted to the oscillation drive motor-motor driver 45 in Step P70 to terminate oscillation phase control.

If the rotational speed is not 0 in Step P69, the rotational speed of the oscillation drive motor 10 is computed in Step P71 from the difference between the deviation obtained by computation—the deviation between the home position signal of the drive motor rotary encoder 27 and the home position signal of the oscillation drive motor rotary encoder 9—and the set oscillation phase, and from the current rotational speed of the drive motor 28 obtained by computation, and is stored in the oscillation drive motor rotational speed memory. Then, in Step P72, the rotational speed of the oscillation drive motor 10 obtained by computation is outputted to the oscillation drive motor-motor driver 45, and the program returns to Step P53 to continue oscillation phase control.

In the present embodiment, as described above, the shaft detent air cylinder 64 for restraining the rotation of the rotating shaft 6 is provided, and the operator manually loosens the shaft locking bolt 22*a*, enabling the sleeve 12 and the rotating member 62 to be rotated relative to the rotating shaft 6 which supports the sleeve 12 and the rotating member 62. Moreover, the rotation of the rotating shaft 6 is restrained by the shaft detent air cylinder 64 and, in this state, the sleeve 12 and the rotating member 62 are rotated by the oscillation drive motor 10 to adjust the oscillation amount of the oscillating rollers 2*a*, 2*b*, 2*c*, 2*d*. Thus, oscillation amount adjustment can be made semiautomatically with high accuracy using a motor or the like, whereby marked reduction of the working time is achieved.

During a routine operation, moreover, the disk 14 makes a grinding motion upon the oscillatory motion of the inclined shaft portion 7. Thus, the oscillating rollers 2*a*, 2*b*, 2*c*, 2*d* swing in the axial direction. At this time, the oscillating rollers 2*a*, 2*b*, 2*c*, 2*d* swing sequentially in shifted phases in accordance with the order of their arrangement. As a result, their ink distribution is performed in different phases, and their swing takes place individually, so that high quality printing free from shock can be done. In addition, the oscillation mechanism is compact, thus ensuring space saving.

Fourth Embodiment

Figure 15:
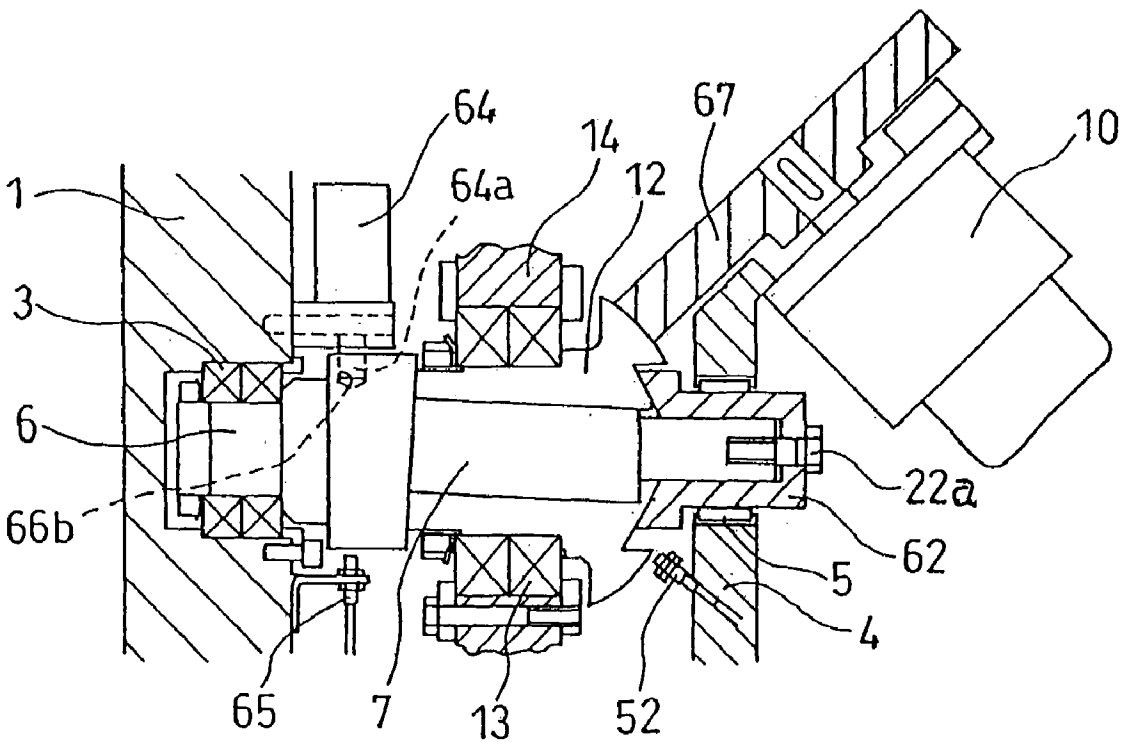
FIG. 15 is a front sectional view of an oscillating roller swing device of an inking device in a printing press, showing a fourth embodiment of the present invention.
Figure 16:
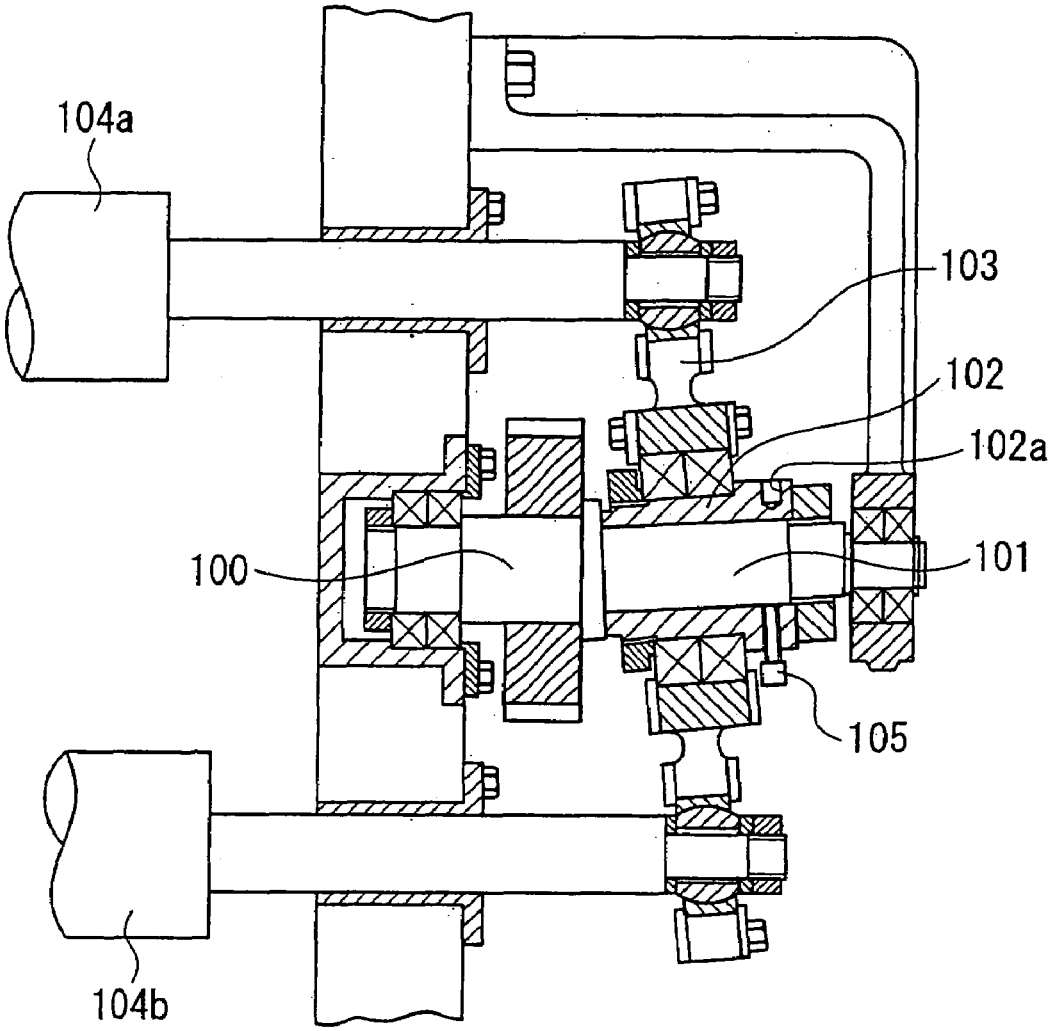
FIG. 16 is a front sectional view of an oscillating roller swing device of an inking device, showing a conventional example.

FIG. 15 is a front sectional view of an oscillating roller swing device of an inking device in a printing press, showing a fourth embodiment of the present invention.

This embodiment is an embodiment in which the piston rod tip 64*a* of the shaft detent air cylinder 64 in the Third Embodiment is fitted into a round hole 66*b* formed in a part of the outer periphery of the rotating shaft 6 to lock the rotating shaft 6 and, in this state, the shaft locking bolt 22*a* is loosened (removed), whereafter the sleeve 12 is rotated by the oscillation drive motor 10 via a friction wheel 67, thereby making it possible to adjust the oscillation amount of the oscillating rollers 2*a*, 2*b*, 2*c*, and 2*d*. The features of the present embodiment are the same as those of the Third Embodiment, except that the home position phase detection sensor 52, such as an optical sensor, for detecting a phase home position reference at the outer peripheral surface of the sleeve 12 is fitted into the support plate (support portion) 4.

In the present embodiment as well, oscillation amount adjustment is made semiautomatically using the oscillation drive motor 10, whereby the same actions and effects as in the Third Embodiment are obtained.

While the present invention has been described by the above embodiments, it is to be understood that the invention is not limited thereby, but may be varied or modified in many other ways. For example, the dedicated oscillation drive motor 10 need not be used in the Third and Fourth Embodiments, and instead the rotating shaft 6 may be rotated and driven by the drive motor 28 via a gear mechanism. Such variations or modifications are not to be regarded as a departure from the spirit and scope of the invention, and all such variations and modifications as would be obvious to one skilled in the art are intended to be included within the scope of the appended claims.

What is claimed is:

1. An oscillation amount adjusting device for an oscillating roller in an oscillating roller swing device, said oscillating roller swing device including, an oscillating roller swung in an axial direction, a rotating shaft rotatably supported by a frame and having an inclined shaft portion inclined to an axis of said oscillating roller, a cylindrical sleeve rotatably fitted on said inclined shaft portion of said rotating shaft and having an outer peripheral surface inclined to an axis of said inclined shaft portion, sleeve locking-release means for rendering said sleeve nonrotatable or rotatable relative to said rotating shaft, an oscillating roller engagement member rotatably supported on said sleeve and having a first engagement portion engaging said oscillating roller, and drive means for rotating said sleeve, said oscillation amount adjusting device, comprising:

a second engagement portion provided in said rotating shaft; and restraining means for engaging said second engagement portion to restrain rotation of said rotating shaft, wherein said sleeve locking-release means is brought into a release state and said restraining means is brought into engagement with said second engagement portion and, with said release state and said engagement being maintained, said drive means is driven.

2. The oscillation amount adjusting device for an oscillating roller according to claim 1, wherein said drive means is a dedicated motor, and said dedicated motor is connected to a rotating member via a gear mechanism, said rotating member being detachably fitted on said rotating shaft, being rotatably supported by a support portion, and being nonrotatably engaged with said sleeve.

3. The oscillation amount adjusting device for an oscillating roller according to claim 1, wherein said drive means is a dedicated motor, and said dedicated motor directly rotates said sleeve via a friction wheel, said sleeve nonrotatably engaging a rotating member, said rotating member being detachably fitted on said rotating shaft and being rotatably supported by a support portion.

4. The oscillation amount adjusting device for an oscillating roller according to claim 1, further comprising:

restraining means moving means for moving said restraining means between an engagement position where said restraining means is brought into engagement with said second engagement portion and a retreat position where said restraining means is out of engagement with said second engagement portion.

5. The oscillation amount adjusting device for an oscillating roller according to claim 1, further comprising:

a rotating shaft rotation position detector for detecting a rotation position of said rotating shaft;

an oscillation amount setting device for setting a swing amount of said oscillating roller;

a drive amount detector for detecting a drive amount of said drive means; and a control device for controlling said drive means in response to a signal from said rotating shaft rotation position detector, a signal from said oscillation amount setting device, and a signal from said drive amount detector.

* * * * *